US006422692B2

(12) United States Patent
Yamazaki et al.

(10) Patent No.: US 6,422,692 B2
(45) Date of Patent: Jul. 23, 2002

(54) INK CARTRIDGE

(75) Inventors: Atsushi Yamazaki, Matsumoto; Ayao Ogawa, Hotaka-machi, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/781,676

(22) Filed: Feb. 12, 2001

(30) Foreign Application Priority Data

Mar. 16, 2000 (JP) ..... 2000-074111
Mar. 16, 2000 (JP) ..... 2000-074113
Mar. 16, 2000 (JP) ..... 2000-074114

(51) Int. Cl.[7] ..... B41J 2/175
(52) U.S. Cl. ..... 347/86; 347/93
(58) Field of Search ..... 347/84, 85, 86, 347/87, 92, 93

(56) References Cited

U.S. PATENT DOCUMENTS 5,657,065 A * 8/1997 Lin ..... 347/93
6,137,512 A * 10/2000 Higuma et al. ..... 347/86

* cited by examiner

*Primary Examiner*—Anh T. N. Vo
(74) *Attorney, Agent, or Firm*—Hogan & Hartson, L.L.P.

(57) ABSTRACT

There is provided an ink cartridge that is capable of supplying a pigment-based ink and at the same time suppressing the mixing of a sedimentary ink into the supplied pigment-based ink, or suppressing the generation of the sedimentary ink even when left unused, or removing the sedimentary ink by initial delivery of the ink after the cartridge is left unused, thereby reducing unevenness of printing. An ink reservoir holds an ink absorbent material therein for storage of the pigment-based ink. An ink delivery block is formed at a lower portion of the ink reservoir, and has a communication passage formed therethrough such that it extends from an outside of the ink reservoir up to an inner opening of the communication passage opening into an inside of the ink reservoir, for communication between the outside and the inside of the ink reservoir. The sedimentary ink is suppressed from flowing to the inner opening.

13 Claims, 17 Drawing Sheets

INK CARTRIDGE

BACKGROUND OF THE INVENTION

1. Field of the Invention

This invention relates to an ink cartridge for use with an ink jet printer or the like.

2. Prior Art

An ink cartridge IC for holding a dye-based ink, shown in FIGS. 17A and 17B, for instance, includes an ink reservoir (so-called ink tank) filled with an ink absorbent material FA, and an ink delivery block, 26 formed in a bottom of the cartridge in a manner protruding downward therefrom. The ink delivery block 26 is formed with a communication passage 27 extending therethrough into the ink reservoir, and holds an ink absorbent material FB (ink filter) at an inner portion of the communication passage 27. In the above construction, the ink cartridge IC is formed to have a rectangular inner shape so as to hold a larger amount of ink in a space limited in size and at the same time make the cartridge easy to manufacture (mold in one piece). Further, to make the whole ink cartridge compact in size by reducing the size of the protruding block formed in the bottom, the partition wall defining the communication passage 27 is extended into the inner space of the ink reservoir and the ink absorbent material FB is retained inside the inner peripheral surface of the partition wall.

In contrast to the dye-based ink having a coloring matter solved therein, a pigment-based ink contains an insoluble coloring matter (pigment) having a large particle size. Therefore, the pigment-based ink is excellent in light resistance when illuminated after printing, and difficult to fade. On the other hand, the coloring matter (pigment) of the pigment-based ink is dispersed in the ink with particles thereof floating therein, and hence liable to settle out or sediment with the lapse of time. (Although some inks generally classified into "the dye-based ink" contain a coloring matter which settles out, throughout the specification and appended claims, the term "pigment-based ink" is used to mean "an ink whose coloring matter settles out" including the above-mentioned exceptional type of dye-based ink.) Accordingly, when the ink cartridge IC for holding a dye-based ink, described above with reference to FIGS. 17A and 17B, is used for holding a pigment-based ink, sedimentation of the ink proceeds especially in regions filled with ink alone (ink-filled regions) DIa, DIb, to produce an ink having a high coloring matter concentration (i.e. a portion of the above pigment-based ink, which is increased in coloring matter concentration by sedimentation of the coloring matter: hereinafter referred to as "sedimentary ink"). The sedimentary ink irregularly flows out during printing to cause unevenness of printing such that the printing is carried out e.g. with a high print density immediately after the start of printing, but with a lowered print density thereafter.

SUMMARY OF THE INVENTION

It is a first object of the invention to provide an ink cartridge that is capable of supplying a pigment-based ink and at the same time suppressing the mixing of a sedimentary ink into a pigment-based ink supplied, thereby reducing unevenness of printing.

It is a second object of the invention to provide an ink cartridge that is capable of supplying a pigment-based ink and at the same time suppressing the generation of a sedimentary ink even when left unused, thereby reducing unevenness of printing.

It is a third object of the invention to provide an ink cartridge that is capable of supplying a pigment-based ink and at the same time removing a sedimentary ink by initial delivery of the ink after the cartridge is left unused, thereby reducing unevenness of printing.

To attain the first object, according to a second aspect of the invention, there is provided an ink cartridge comprising:

an ink reservoir holding an ink absorbent material therein for storage of a pigment-based ink;

an ink delivery block formed at a lower portion of the ink reservoir, and having a communication passage formed therethrough such that the communication passage extends from an outside of the ink reservoir up to an inner opening of the communication passage which opens into an inside of the ink reservoir, for communication between the outside and the inside of the ink reservoir; and a sedimentary ink supply-suppressing member for suppressing flow of a sedimentary ink to the inner opening, the sedimentary ink having an increased coloring matter concentration caused by sedimentation of a coloring matter floating in the pigment-based ink.

This ink cartridge includes an ink reservoir holding an ink absorbent material therein for storage of a pigment-based ink, and an ink delivery block formed with a communication passage for communicating between the inside and outside of the ink reservoir. The ink cartridge has the same basic construction as that of the conventional ink cartridge, and when the ink cartridge is left unused, a sedimentary ink is produced. If the ink is delivered as it is, the sedimentary ink is mixed into the ink (pigment-based ink), thereby causing unevenness of printing. Therefore, in order to suppress the mixing of a sedimentary ink into the supplied ink, the ink cartridge has a sedimentary ink supply-suppressing member that prevents flow of a sedimentary ink to the inner opening. This makes it possible to provide an ink cartridge that is capable of supplying a pigment-based ink, and at the same time suppressing the mixing of a sedimentary ink into the supplied pigment-based ink, thereby reducing unevenness of printing.

Preferably, the pigment-based ink is supplied by being drawn in by a predetermined suction force, and the inner opening is arranged above a lowermost bottom surface inside the ink reservoir, the sedimentary ink supply-suppressing member comprising another ink absorbent material different from the ink absorbent material, the another ink absorbent material having an ink-holding force larger than the predetermined suction force, and being arranged in a bottom portion of the ink reservoir at a location lower than the inner opening.

According to this preferred embodiment, while the pigment-based ink is supplied by being drawn in by a predetermined suction force, the inner opening is arranged above the lowermost bottom surface inside the ink reservoir, and hence a sedimentary ink is liable to be generated in a bottom portion of the ink reservoir lower than the inner opening. To cope with this, the ink absorbent material having an ink-holding force larger than the predetermined suction force for supply of the ink is arranged in the bottom portion of the ink reservoir lower than the inner opening, whereby it is possible to hold the sedimentary ink from being delivered as part of the pigment-based ink. This makes it possible to provide an ink cartridge that is capable of supplying a pigment-based ink, and at the same time suppressing the mixing of a sedimentary ink into the supplied pigment-based ink, thereby reducing unevenness of printing.

Alternatively, the inner opening is arranged above a lowermost bottom surface inside the ink reservoir, and the sedimentary ink supply-suppressing member comprises a sedimentary ink receiving member arranged in a bottom portion of the ink reservoir below the inner opening, for receiving the sedimentary ink.

According to this preferred embodiment, the inner opening is arranged above the lowermost bottom surface inside the ink reservoir, and hence a sedimentary ink is liable to be generated in a bottom portion of the ink reservoir lower than the inner opening. To cope with this, a sedimentary ink receiving member is arranged in the bottom portion of the ink reservoir lower than the inner opening for receiving the sedimentary ink, whereby it is possible to hold the sedimentary ink from being delivered as part of the pigment-based ink. This makes it possible to provide an ink cartridge that is capable of supplying a pigment-based ink, and at the same time suppressing the mixing of a sedimentary ink into the pigment-based ink supplied, thereby reducing unevenness of printing.

Alternatively, the sedimentary ink supply-suppressing member comprises a flow slowing lid in intimate contact with the ink delivery block such that the flow slowing lid covers the inner opening, for slowing down flow of the sedimentary ink to the inner opening, and the pigment-based ink is supplied via the flow slowing lid.

According to this preferred embodiment, a flow slowing lid as the sedimentary ink supply-suppressing member is in intimate contact with the ink delivery block such that the flow slowing lid covers the inner opening, for slowing down flow of the sedimentary ink to the inner opening, and the pigment-based ink is supplied via the flow slowing lid. A typical example of the flow slowing lid is a mesh (mesh filter). When passing through the mesh, the sedimentary ink is mixed with other part of the pigment-based ink (having a lower concentration), and the concentration of the sedimentary ink is reduced. This acts to make uniform the concentration of the mixture of the sedimentary ink and other part of the pigment-based ink. This makes it possible to provide an ink cartridge that is capable of supplying a pigment-based ink, and at the same time suppressing the mixing of a sedimentary ink into the pigment-based ink supplied, thereby reducing unevenness of printing.

Alternatively, the sedimentary ink supply-suppressing member comprises an ink filter formed of a predetermined ink absorbent material and held within the communication passage at a location near the inner opening, and a lid joined to a top of the filter for close contact therewith such that the lid covers the inner opening to block the communication passage, and the pigment-based ink is supplied by being drawn in by a predetermined suction force via the ink filter through a gap formed between the lid and the ink delivery block when the lid is pressed upward via the ink filter.

According to this preferred embodiment, the sedimentary ink supply-suppressing member comprises an ink filter formed of a predetermined ink absorbent material and held within the communication passage at a location near the inner opening, and a lid joined to an upper surface of the filter for close contact therewith such that the lid covers the inner opening to block the communication passage. Therefore, when the ink cartridge is left unused, no ink is supplied into the communication passage, and hence no sedimentary ink is generated within the communication passage (no ink-filled region DIb). Further, the pigment-based ink is supplied by being drawn in by a predetermined suction force via the ink filter through a gap formed between the lid and the ink delivery block when the lid is pressed upward via the ink filter. Therefore, even if there is possibility of generation of the sedimentary ink, the sedimentary ink flows through the gap while appropriately mixing with other part of the pigment-based ink having a lower concentration, so that the concentration of the coloring ink is lowered to make uniform the concentration of the whole ink. This makes it possible to provide an ink cartridge that is capable of supplying a pigment-based ink, and at the same time suppressing the mixing of a sedimentary ink into the pigment-based ink supplied, thereby reducing unevenness of printing.

Alternatively, the sedimentary ink supply-suppressing member comprises a plurality of partitions arranged such that the plurality of partitions partially block flow of the coloring matter in a direction of sedimentation thereof, and the ink reservoir is divided by the partitions into a plurality of blocks, such that openings not filled by the plurality of partitions and thereby connecting between adjacent ones of the plurality of blocks are not aligned in the direction of sedimentation of the coloring matter.

According to this preferred embodiment, the sedimentary ink supply-suppressing member comprises a plurality of partitions arranged such that the plurality of partitions partially block flow of the coloring matter in a direction of sedimentation thereof, and the ink reservoir is divided by the partitions into a plurality of blocks, such that openings not filled by the plurality of partitions and thereby connecting between adjacent ones of the plurality of blocks are not aligned in the direction of sedimentation of the coloring matter. In this case, since the plurality of blocks are separated by the partitions, ink flow paths between the blocks are formed by the plurality of openings. The plurality of openings are not aligned in the direction of sedimentation of the coloring matter, and therefore even if the ink cartridge is left unused to cause the coloring matter to settle out, the coloring matter only settles out until they reach the next partition, so that the increase in the concentration of the coloring matter is not large. Further, the ink flow path in each block does not extend in the direction of sedimentation of the coloring matter, but ink flows in a dog-legged manner, so that portions of the ink having different concentrations are appropriately mixed with each other to make uniform the concentration of the mixture. This makes it possible to prevent the concentration of the coloring matter from becoming high. That is, the ink cartridge is capable of suppressing the generation of a sedimentary ink having an extremely high concentration, and supplying a pigment-based ink while reducing unevenness of printing while.

Alternatively, the sedimentary ink supply-suppressing member comprises a plurality of protrusions provided on an inner wall of the ink reservoir, for compressing the ink absorbent material.

According to this preferred embodiment, the sedimentary ink supply-suppressing member comprises a plurality of protruding portions arranged on the inner wall surface of the ink reservoir, for compressing the ink absorbent material. In this case, the ink absorbent material is compressed by the protruding portions arranged on the inner wall surface, so that an ink holding force (ink meniscus force) is increased, whereby it becomes possible to suppress the migration of the ink and the diffusion of the coloring matter, and thereby suppress sedimentation of the coloring matter. Further, even if the sedimentary ink is generated along the inner wall surface, the protruding portions thereon suppress flow of the sedimentary ink, whereby it is possible to provide an ink cartridge that is capable of supplying a pigment-based ink, and at the same time suppressing the mixing of a sedimentary ink into the pigment-based ink supplied, thereby reducing unevenness of printing.

To attain the second object, according to a second aspect of the invention, there is provided an ink cartridge comprising:

an ink reservoir holding an ink absorbent material therein for storage of a pigment-based ink;

an ink delivery block formed at a lower portion of the ink reservoir, and having a communication passage formed therethrough such that the communication passage extends from an outside of the ink reservoir up to an inner opening of the communication passage which opens into an inside of the ink reservoir, for communication between the outside and the inside of the ink reservoir; and a sedimentary ink generation-suppressing member for suppressing generation of a sedimentary ink having an increased pigment concentration caused by sedimentation of a coloring matter floating in the pigment-based ink, the sedimentary ink generation-suppressing member slowing down flow of a coloring matter within a predetermined sedimentation region where sedimentation of the coloring matter easily proceeds, or flow of the pigment-based ink into the predetermined sedimentation region.

This ink cartridge includes an ink reservoir holding an ink absorbent material therein for storage of a pigment-based ink, and an ink delivery block formed with a communication passage for communicating between the inside and outside of the ink reservoir. The ink cartridge has the same basic construction as that of the conventional ink cartridge, and when the ink cartridge is left unused, a sedimentary ink is produced. If the ink is delivered as it is, the sedimentary ink is mixed into the ink (pigment-based ink) and then delivered, thereby causing unevenness of printing. Therefore, in order to suppress the generation of a sedimentary ink, the ink cartridge has a sedimentary ink generation-suppressing member that prevents or slows down flow (sedimentation) of a coloring matter within a predetermined sedimentation region where sedimentation of the coloring matter easily proceeds, or flow of the pigment-based ink into the predetermined sedimentation region. This makes it possible to provide an ink cartridge that is capable of supplying a pigment-based ink, and at the same time suppressing the generation of a sedimentary ink even when the pigment-based ink is left unused, thereby reducing unevenness of printing.

Preferably, the inner opening is arranged above a lowermost bottom surface inside the ink reservoir, and the sedimentary ink generation- suppressing member is formed by an ink absorbent material having the same properties as the ink absorbent material and being arranged in a manner filling into a portion of the ink reservoir lower than the inner opening.

According to this preferred embodiment, since the inner opening is arranged above the lowermost bottom surface inside the ink reservoir, and a sedimentary ink is liable to be generated in a bottom portion of the ink reservoir lower than the inner opening. To cope with, the ink absorbent material is filled into a portion of the ink reservoir lower than the inner opening, whereby a region filled with ink alone (ink-filled region) can be reduced. This makes it possible to provide an ink cartridge that is capable of suppressing the generation of a sedimentary ink by reduction of an ink-filled region even if the ink cartridge is left unused, whereby when a pigment-based ink is supplied or delivered for printing, unevenness of printing can be reduced.

Alternatively, the inner opening is arranged above a lowermost bottom surface inside the ink reservoir, and the sedimentary ink generation-suppressing member is formed by an ink absorbent material having the same properties as the ink absorbent material and being arranged in an inner bottom portion of the ink reservoir below the inner opening.

According to this preferred embodiment, since the inner opening is arranged above the lowermost bottom surface inside the ink reservoir, and a sedimentary ink is liable to be generated in a bottom portion below the inner opening, of the inner bottom surface of the ink reservoir. Therefore, the ink absorbent material is arranged at the bottom portion below the inner opening, whereby a region filled with ink alone (ink-filled region) can be reduced. This makes it possible to provide an ink cartridge that is capable of suppressing the generation of a sedimentary ink by the reduced ink-filled region even if the ink cartridge is left unused, whereby when a pigment-based ink is supplied or delivered for printing, unevenness of printing can be reduced.

Alternatively, the sedimentary ink generation-suppressing member comprises an ink filter formed of an ink absorbent material larger in size than the inner opening and being forcedly filled into a portion of the communication passage near the inner opening to be held therein, and the pigment-based ink is supplied by being drawn in via the ink filter by a predetermined suction force.

According to this preferred embodiment, the pigment-based ink is delivered by being sucked via the ink filter by a predetermined suction force. In this case, since the size of ink filter is larger than that of the inner opening, the filter is forcedly filled into the communication passage e.g. by compression, to be retained therein. Accordingly, while the ink cartridge is left unused, the ink filter serves as the lid of the communication passage to stop (or reduce) flow of the pigment-based ink into the communication passage. Hence, there is not generated any sedimentary ink within the communication passage. That is, the ink cartridge is capable of suppressing the generation of a sedimentary ink by elimination of an ink-filled region even if the ink cartridge is left unused, whereby when a pigment-based ink is supplied or delivered for printing, unevenness of printing can be reduced.

Alternatively, the sedimentary ink generation-suppressing member comprises an ink filter formed of a predetermined ink absorbent material and being held within the communication passage at a location near the inner opening, and a nail portion provided on the ink delivery block such that the nail portion covers a gap between an inner peripheral surface of the ink delivery block defining the communication passage and the ink filter while urging the ink filter downward, and the pigment-based ink is supplied by being drawn in via the ink filter by a predetermined suction force.

According to this preferred embodiment, the pigment-based ink is delivered by being sucked via the ink filter by the predetermined suction force. In this case, the ink delivery block is provided with the nail portion which covers a gap between the inner peripheral surface of the ink delivery block defining the communication passage and the ink filter to urge the ink filter downward, and hence when the ink cartridge is left unused, the nail portion covers the gap between the inner peripheral surface of the ink delivery block defining the communication passage and the ink filter, and serves as the lid of the communication passage together with the ink filter, thereby reducing supply of ink to the communication passage. Therefore, the generation of a sedimentary ink is suppressed within the communication passage. That is, the ink cartridge is capable of suppressing the generation of a sedimentary ink even if the ink cartridge is left unused, whereby when a pigment-based ink is supplied or delivered for printing, unevenness of printing can be reduced.

Alternatively, the pigment-based ink is supplied in a state in which the ink filter is pressed upward from below, and the ink filter is formed of a laminate of a plurality of types of ink absorbent materials different in resilience from each other.

According to this preferred embodiment, the pigment-based ink is delivered when the ink filter is pressed upward from below. In this case, the ink filter is formed of a laminate of a plurality of types of ink absorbent materials different in resilience from each other, so that it is possible to finely adjust the resilience of the ink absorbent material as a whole.

Alternatively, the sedimentary ink generation-suppressing member comprises an ink filter formed of a predetermined ink absorbent material and arranged within the communication passage at a location near the inner opening, and a filling member for filling a gap between the inner peripheral surface of the ink delivery block defining the communication passage and the ink filter, and the pigment-based ink is supplied by being drawn in via the ink filter by a predetermined suction force.

According to this preferred embodiment, the pigment-based ink is delivered by being sucked via the ink filter by the predetermined suction force. In this case, in addition to the ink filter, the ink delivery block holds the filling material for filling the gap (portion to form an ink-filled region) between the inner peripheral surface of the ink delivery block defining the communication passage and the ink filter. This makes it possible to provide an ink cartridge that is capable of suppressing the generation of a sedimentary ink by elimination of an ink-filled region even if the ink cartridge is left unused, whereby when a pigment-based ink is supplied or delivered for printing, unevenness of printing can be reduced.

Alternatively, the sedimentary ink generation-suppressing member comprises an ink filter formed of a predetermined ink absorbent material and held within the communication passage at a location near the inner opening, and a lid joined to a top of the filter for close contact therewith such that the lid covers the inner opening to block the communication passage, and the pigment-based ink is supplied by being drawn in via the ink filter by a predetermined suction force through a gap formed between the lid and the ink delivery block when the lid is pressed upward via the ink filter.

According to this preferred embodiment, the sedimentary ink generation-suppressing member comprises an ink filter formed of a predetermined ink absorbent material and held within the communication passage at a location near the inner opening, and a lid joined to a top of the filter for close contact therewith such that the lid covers the inner opening to block the communication passage. Therefore, when the ink cartridge is left unused, ink is not supplied to the communication passage, and there is not generated any sedimentary ink within the communication passage. That is, according to this preferred embodiment, the ink cartridge is capable of suppressing the generation of a sedimentary ink by elimination of an ink-filled region even if the ink cartridge is left unused, whereby when a pigment-based ink is supplied or delivered for printing, unevenness of printing can be reduced.

Alternatively, the sedimentary ink generation-suppressing member comprises a plurality of partitions arranged such that the plurality of partitions partially block flow of the coloring matter in a direction of sedimentation thereof, and the ink reservoir is divided by the partitions into a plurality of blocks, such that openings not filled by the plurality of partitions and thereby connecting between adjacent ones of the plurality of blocks are not aligned in the direction of sedimentation of the coloring matter.

According to this preferred embodiment, the sedimentary ink generation-suppressing member comprises a plurality of partitions arranged such that the plurality of partitions partially block flow of the coloring matter in a direction of sedimentation thereof, and the ink reservoir is divided by the partitions into a plurality of blocks, such that openings not filled by the plurality of partitions and thereby connecting between adjacent ones of the plurality of blocks are not aligned in the direction of sedimentation of the coloring matter. In this case, since the ink cartridge has the plurality of blocks divided by the partitions, ink flow paths between the blocks are formed by the plurality of openings. The plurality of openings defined by the respective partitions are not aligned in the direction of sedimentation of the coloring matter, and even if the ink cartridge is left unused to cause the coloring matter to settle out, the coloring matter only settles out until they reach the next partition where the sedimentation is prevented from proceeding. This makes it possible to prevent the concentration of the coloring matter from becoming high. That is, the ink cartridge is capable of suppressing the generation of a sedimentary ink having an extremely high concentration, whereby when a pigment-based ink is supplied or delivered for printing, unevenness of printing can be reduced.

Alternatively, the sedimentary ink generation-suppressing member comprises a plurality of protrusions provided on an inner wall of the ink reservoir, for compressing the ink absorbent material.

According to this preferred embodiment, the sedimentary ink generation-suppressing member comprises a plurality of protrusions arranged on the inner wall surface of the ink reservoir, for compressing the ink absorbent material. In this case, the ink absorbent material is compressed by the protrusions arranged on the inner wall surface, and an ink holding force (ink meniscus force) is increased, thereby making it possible to provide an ink cartridge that is capable of suppressing the migration of ink and the diffusion of the coloring matter, and inhibiting the generation of a sedimentary ink, whereby when a pigment-based ink is supplied or delivered for printing, unevenness of printing can be reduced.

Alternatively, the inner opening opens in a lowermost portion within the ink reservoir such that a bottom surface of the ink reservoir is located above the inner opening, and slopes downward toward the inner opening, and the ink absorbent material is arranged on a whole of the bottom surface.

According to this preferred embodiment, as a sedimentary ink generation-suppressing structure, the inner opening opens in the lowermost surface of the ink reservoir such that the bottom surface of the ink reservoir is located above the inner opening, and slopes downward toward the inner opening. This makes it possible to eliminate a portion corresponding to an ink-filled region, thereby enhancing the ink replacement effect in which one portion of the ink is replaced by another, and even if the ink cartridge is left unused, it becomes difficult for a sedimentary ink to deposit. In addition, the ink absorbent material is provided on the whole bottom surface of the ink reservoir. Therefore, the ink cartridge is capable of suppressing the diffusion of a coloring matter of the ink, and inhibiting the generation of a sedimentary ink, whereby when a pigment-based ink is supplied or delivered for printing, unevenness of printing can be reduced.

To attain the third object, according to a third aspect of the invention, there is provided an ink cartridge comprising:

an ink reservoir holding an ink absorbent material therein for storage of a pigment-based ink; and an ink delivery block formed at a lower portion of the ink reservoir, and having a communication passage formed therethrough such that the communication passage extends from an outside of the ink reservoir up to an inner opening of the communication passage which opens into an inside of the ink reservoir, for communication between the outside and the inside of the ink reservoir;

wherein the ink cartridge is constructed to accelerate flow of the pigment-based ink from a predetermined sedimentation region wherein sedimentation of a coloring matter easily proceeds toward the inner opening, so as to enable removal of a sedimentary ink having an increased coloring matter concentration caused by the sedimentation of the coloring matter floating in the pigment-based ink, by initial supply of the ink after the ink cartridge is left unused.

This ink cartridge includes an ink reservoir holding an ink absorbent material therein for storage of a pigment-based ink, and an ink delivery block formed with a communication passage for communicating between the inside and outside of the ink reservoir. The ink cartridge has the same basic construction as that of the conventional ink cartridge, and when the ink cartridge is left unused, a sedimentary ink is produced. If the ink is delivered as it is, the sedimentary ink is mixed into the ink (pigment-based ink), thereby causing unevenness of printing. Therefore, in order to make it possible to remove the sedimentary ink by initial delivery of the ink after being left unused, the ink cartridge is constructed to accelerate flow of the pigment-based ink from a predetermined sedimentation region wherein sedimentation of the coloring matter easily proceeds toward the inner opening.

More specifically, if the sedimentary ink generated and accumulated when the ink cartridge is left unused can be removed by an initial delivery of the ink carried out thereafter, there remains only the pigment-based ink exclusive of the sedimentary ink, whereby it is possible to reduce unevenness of printing carried out thereafter. Particularly, in the ink jet printer or the like, after the ink cartridge thereof is left unused, an ink ejection operation (so-called cleaning operation) is carried out to clear nozzles in the print head, and hence if the sedimentary ink can be discharged in the course of this operation, it contributes to reduction of unevenness of printing which can occur after the start of normal printing. That is, the ink cartridge is capable of supplying pigment-based ink, and at the same time removing sedimentary ink by initial delivery of the ink after the ink cartridge is left unused, thereby reducing unevenness of printing.

Preferably, the inner opening opens in a lowermost portion within the ink reservoir such that a bottom surface of the ink reservoir is located above the inner opening, and slopes downward toward the inner opening.

According to this preferred embodiment, the inner opening opens in a lowermost portion within the ink reservoir such that a bottom surface of the ink reservoir is located above the inner opening, and slopes downward toward the inner opening. This construction accelerates the flow of ink from the bottom of the ink reservoir (predetermined sedimentation region within the ink reservoir where the sedimentation of the coloring matter easily proceeds) to the inner opening. Therefore, even if the ink cartridge is left unused, the sedimentary ink is not easily generated, and even when it is generated, it sediments or falls toward the inner opening. Therefore, the ink cartridge is capable of removing the sedimentary ink by initial delivery of the ink after the ink cartridge is left unused, whereby the pigment-based ink can be supplied while reducing unevenness of printing.

Alternatively, the ink supply block holds an ink filter within the communication passage at a location near the inner opening, and the pigment-based ink is supplied by being drawn in via the ink filter by a predetermined suction force, and the ink filter being formed by another ink absorbent material having a smaller ink-holding force than the ink absorbent material.

According to this preferred embodiment, the pigment-based ink is supplied by being drawn in via an ink filter by a predetermined suction force, and the ink filter is formed by another ink absorbent material having a smaller ink-holding force than the ink absorbent material. Therefore, the sedimentary ink in the region filled with the ink alone (predetermined sedimentation region where the sedimentation of the coloring matter easily proceeds; ink-filled regions) is more easily drawn in or sucked than the pigment-based ink (low in concentration of the coloring matter) which is retained by the ink absorbent material with its ink-holding force. Therefore, the ink cartridge is capable of removing the sedimentary ink by initial delivery of the ink after the ink cartridge is left unused, whereby the pigment-based ink can be supplied while reducing unevenness of printing.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

An ink cartridge IC shown in FIGS. 17A and 17B holds a dye-based ink, as described hereinabove. In contrast, an ink cartridge IC1 shown in FIG. 1 according to a first embodiment holds a pigment-based ink. These ink cartridges are both employed as an ink cartridge IC for an ink jet printer shown in FIG. 15 (which show, however, the dye-based ink cartridge IC shown in FIGS. 17A and 17B on behalf of the two types of the ink cartridges). Here, components common to the ink cartridge IC for a dye-based ink, shown in FIGS. 17A and 17B and the FIG. 1 ink cartridge IC1 for a pigment-based ink will be described first.

Figure 15:
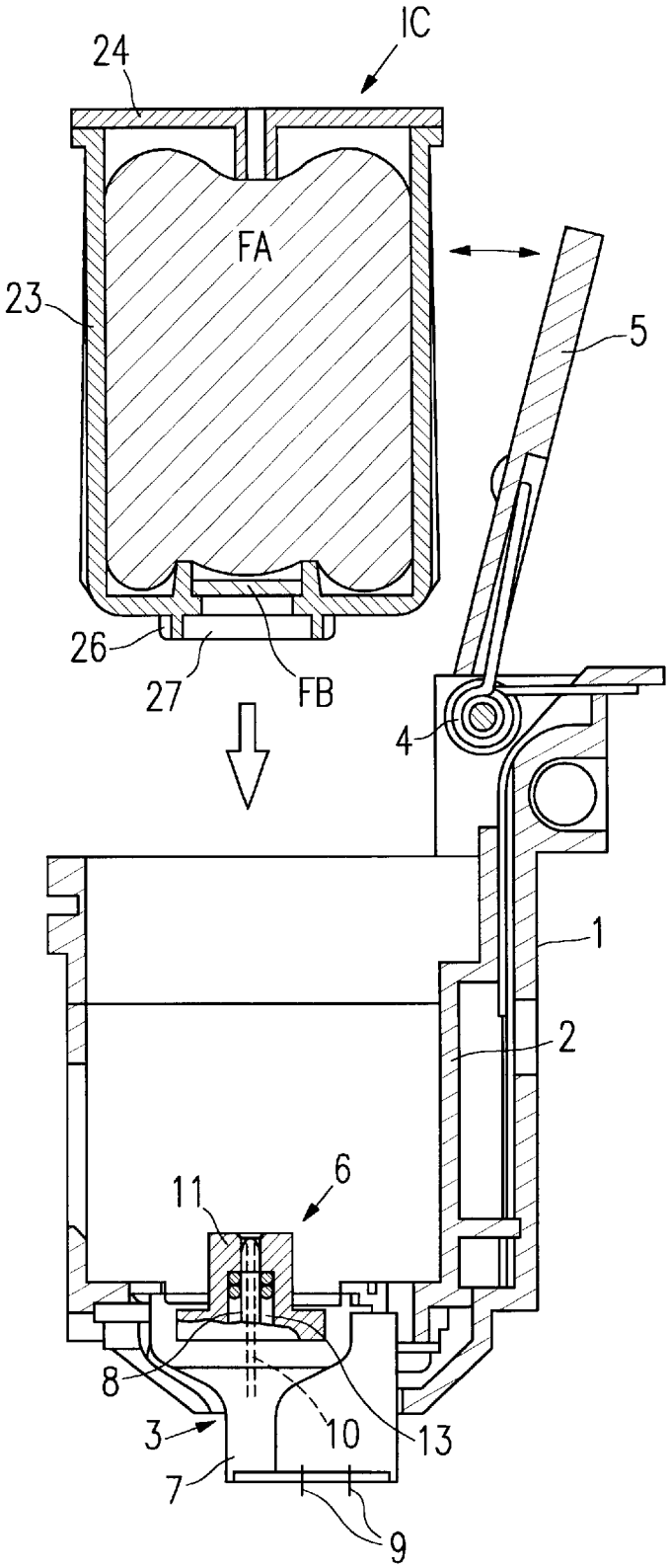
FIG. 15 is an enlarged cross-sectional view showing a print head of an ink jet printer in which is mounted the ink cartridge according to each of the embodiments of the invention, and component parts associated therewith, with the ink cartridge being removed therefrom.

Referring to FIG. 15, on the ink jet printer side, there are provided a cartridge case 1, a cartridge holder 2 rigidly fixed in the cartridge case 1, a print head 3 which has an upper half portion covered by the cartridge case 1 and is rigidly fixed to the bottom of the cartridge holder 2. Further, the cartridge case 1 includes a lid 5 urged by a torsion coiled spring 4 for urging the ink cartridge IC inserted in the cartridge holder 2 toward the print head 3.

As shown in FIGS. 1, 15, 17A and 17B, the ink cartridge IC has a lower casing 23 and an upper casing 24 which constitute an ink reservoir (so-called ink tank) filled with an ink absorbent material FA for holding ink in a state absorbed therein. The ink cartridge IC has a bottom formed with an ink delivery block 26 protruding downward from the bottom surface of the ink cartridge IC. The ink delivery block 26 has a communication passage 27 formed therethrough and extending into the ink reservoir, with an ink absorbent material FB (ink filter) being arranged in an inner portion of the communication passage 27, between the same and the ink absorbent material FA.

When the ink cartridge IC configured as above is mounted in the cartridge holder 2, the communication passage 27 is fitted on an inserting portion 11 of a receiving member 6 provided on the print head 3. Further, the receiving member 6 has an ink inlet passage 13 formed through a central portion thereof along the vertical axis thereof. In the ink inlet passage 13 is inserted a head needle 8 extending from a head body 7. The head needle 8 has an ink passage 10 formed through a central portion thereof along the vertical axis, for communication with ink nozzles 9 of the print head 3. When the head needle 8 is inserted into the ink delivery block 26 of the ink cartridge IC together with the inserting portion 11, the ink passage 10 and the inside of the ink reservoir of the ink cartridge IC are in communication with each other. Ink stored in the ink cartridge IC is drawn in or sucked in this state by a predetermined suction force, whereby the ink is supplied to the ink passage 10.

Figure 1:
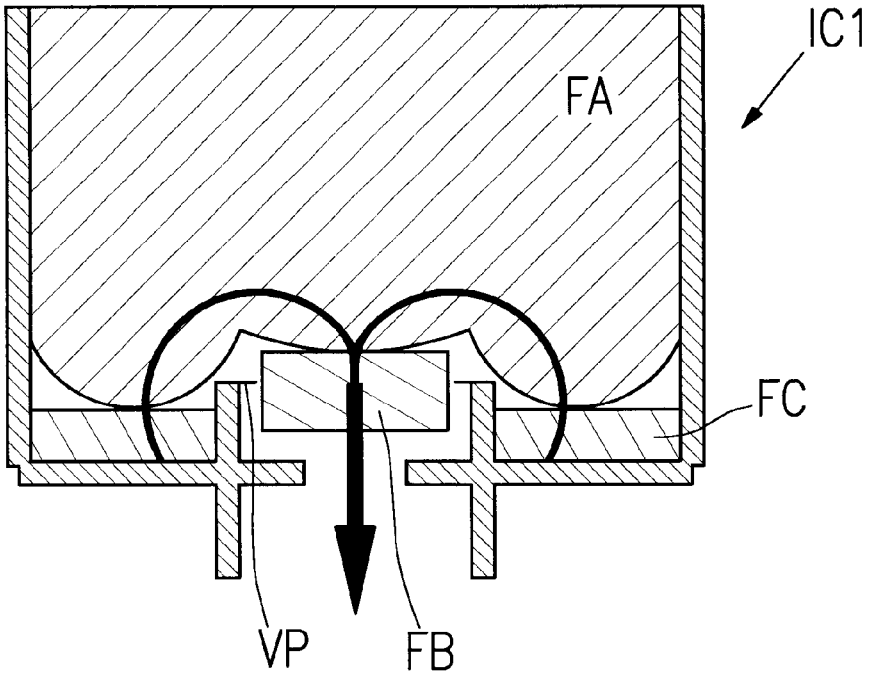
FIG. 1 is a cross-sectional view showing a schematic representation of an ink cartridge according to a first embodiment of the invention, which is useful in explaining an internal construction of the ink cartridge.
Figure 17A:
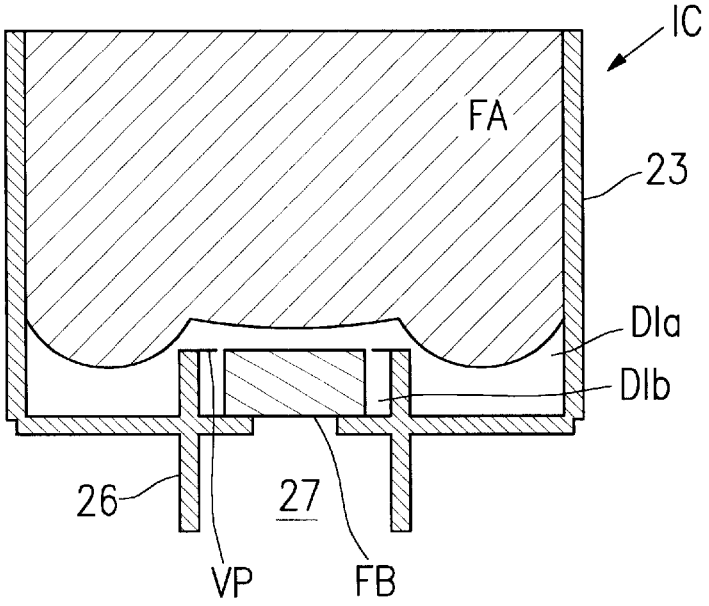
FIG. 17A PRIOR ART
FIGS. 17A and 17B are cross-sectional views each showing a schematic representation of an ink cartridge for holding a dye-based ink.
Figure 17B:
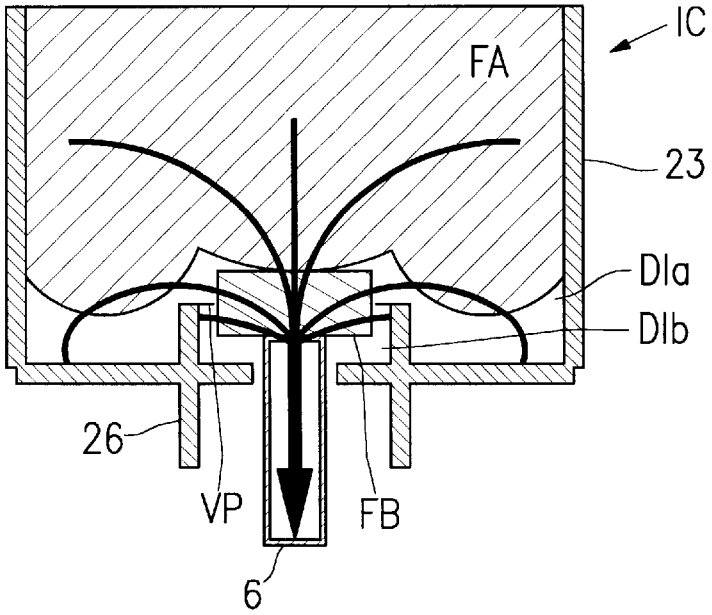
FIG. 17B PRIOR ART

In the FIG. 1 ink cartridge IC1 and the ink cartridge IC shown in FIGS. 17A and 17B, the ink absorbent material FA is formed of a porous material or a fibrous material, which has the functions of retaining ink and preventing leakage of ink or mixing of bubbles into the ink. The ink absorbent material FB as well is formed of a porous material or a fibrous material, which is used for maintaining the quality of ink and assisting supply of ink when the ink cartridge IC is set in the cartridge holder 2. More specifically, when the ink absorbent material FB is urged upward by the receiving member 6, it ensures intimate contact between the ink cartridge IC and the receiving member 6, and serves as a filter for preventing the outflow of foreign matter other than ink from the ink cartridge IC. The ink absorbent material FB has a larger ink holding force (ink meniscus force) than that of the ink absorbent material FA, and has the effect of sucking ink therein by capillary action. Further, a wall of the inner portion of the ink delivery block 26 surrounding the ink absorbent material FB holds the ink absorbent material FB at a predetermined position, and compresses the ink absorbent material FA to strengthen capillary action at a contact portion between the same and the ink absorbent material FA, thereby assisting supply of ink.

Now, in the case of the ink cartridge IC for a dye-based ink, shown in FIGS. 17A and 17B, as shown in the figures, regions filled with ink alone (ink-filled regions) DIa and DIb are produced at locations lower than an inner opening VP (imaginary plane including the inner opening; in the illustrated examples, however, an imaginary horizontal surface including an opening flush with the upper end face of the wall of the inner portion of the ink delivery block 26 surrounding the communication passage 27) of the communication passage 27. On the other hand, in the FIG. 1 ink cartridge IC1 for a pigment-based ink, as shown in the figure, an ink absorbent material FC which is formed of the same porous material or fibrous material as used in the ink absorbent material FA, FB in FIGS. 17A and 17B, but has a larger ink holding force than the suction force for supplying ink to the ink passage 10 is filled in a bottom portion below the level of the inner opening VP.

Figure 16A:
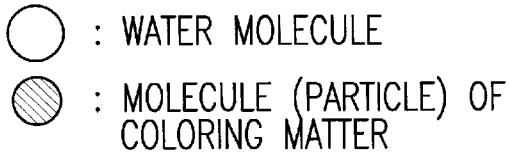
FIGS. 16A to 16D are explanatory views of properties of a pigment-based ink, which are useful in explaining a problem to be solved by the invention.
Figure 16B:
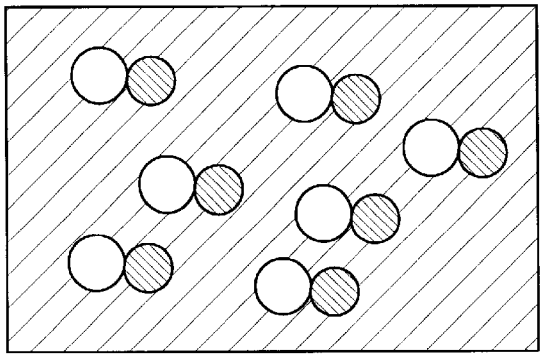
Figure 16C:
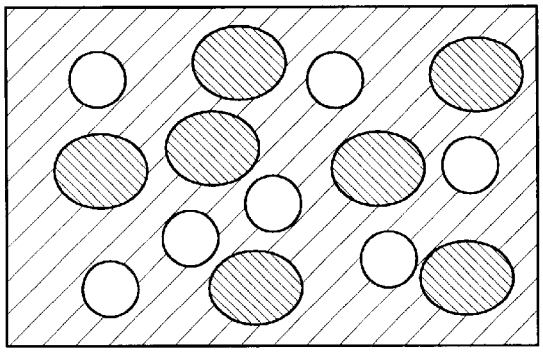
Figure 16D:
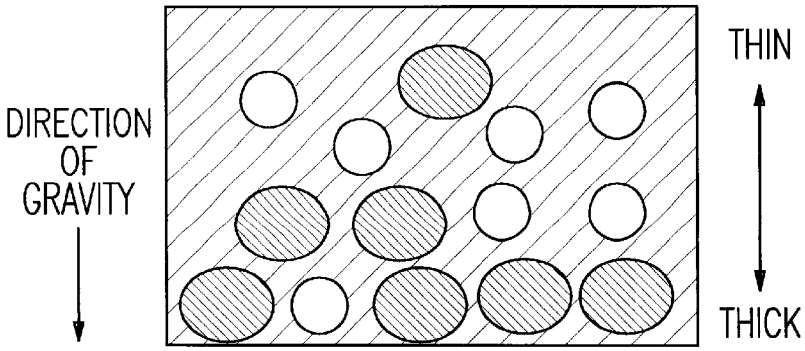

In general, ink is composed of water, a coloring matter (fluid dispersion),and a solvent. The term "dye-based ink" is used to mean a type of ink having a coloring matter solved therein, while the term "pigment-based ink" is used to mean a type of ink having a coloring matter dispersed therein. If water molecules and molecules (or particles) of a coloring matter are illustrated as shown in FIG. 16A, in the case of the dye-based ink, the molecules of water and those of the coloring matter are bound as shown in FIG. 16B, and hence stable, so that the existence of the above ink-filled region DIa and DIb does not present a particular problem. On the other hand, as shown in FIG. 16C, molecules (or particles) of the coloring matter of the pigment-based ink are larger in size than those of the coloring matter of the dye-based ink, and not bound with water molecules but float by themselves, so that they are not stable. Further, when the ink cartridge is left unused, the particles of the coloring matter (pigment) in the pigment-based ink settle out in the direction of gravity, as shown in FIG. 16D, since they are large and heavy, thereby generating a highly concentrated ink (sedimentary ink). Therefore, if a pigment-based ink is employed, there occurs an irregular outflow of the sedimentary ink, which causes unevenness of printing.

Particularly, in the case of an ink cartridge filled with an ink absorbent material for holding an ink, once the coloring mater sediments (settles out), it is difficult to restore a normal state the ink cartridge before it is left unused, that is, a state in which the concentration of the coloring matter (pigment) is uniform. Further, sedimentation of the coloring matter easily proceeds in the ink-filled regions DIa and DIb. To overcome these problems, the ink absorbent material FC which has an ink holding force larger than a suction force for supply of the ink is filled in a region corresponding to the ink-filled region Dia, within the ink cartridge IC1, whereby the sedimentary ink is held in the ink absorbent material FC to prevent the same from flowing out of the cartridge. This makes it possible to suppress supply or delivery of the sedimentary ink as part of the pigment-based ink (sedimentary ink generation suppression structure (1), referred to hereinafter), so that it is possible to deliver the pigment-based ink and at the same time prevent the sedimentary ink from being mixed into the delivered pigment-based ink, whereby the ink cartridge IC1 is capable of reducing unevenness of printing.

In the following, ink cartridges IC for a pigment-based ink, according to other embodiments of the invention, will be described. To reduce unevenness of printing caused by a sedimentary ink, the ink cartridges IC are basically constructed based on the following three concepts (1) to (3):

(1) Construction for suppressing the mixing of a sedimentary ink into a pigment-based ink to be delivered (sedimentary ink supply-suppressing structure)

(2) Construction for suppressing the generation (or sedimentation) of a sedimentary ink (sedimentary ink generation-suppressing structure)

(3) Construction for enabling a sedimentary ink to be eliminated upon the initial supply of ink after the ink cartridge has been left unused (sedimentary ink elimination-accelerating structure)

One or more of the three concepts are applied to each embodiment, and hence, applied ones of the concepts are additionally noted in the following description of each embodiment.

Figure 2:
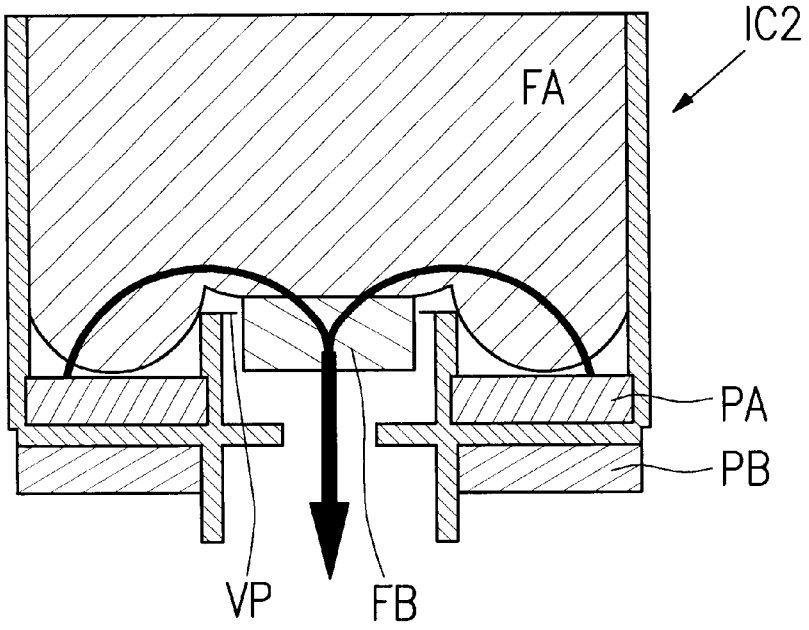
FIG. 2 is a cross-sectional view showing a schematic representation of an ink cartridge according to a second embodiment of the invention, which is useful in explaining an internal construction of the ink cartridge.

Referring to FIG. 2, in an ink cartridge IC2 according to a second embodiment of the invention, the above concept of the ink cartridge IC1 is further developed, and a sedimentary ink reception block for receiving a sedimentary ink is arranged in place of the ink absorbent material FC. More specifically, for instance, as shown in the figure, an ink container PA for holding a pigment-based ink is arranged. This ink container PA may be configured such that it can be replaced from the outside of the cartridge IC2. Further, in addition to the ink container PA arranged inside the ink reservoir, an ink container PB may be arranged outside the ink reservoir such that the ink container PB can communicate with the ink container PA to hold ink therein. In this case, the ink cartridge IC2 may be constructed such that only the ink container PB can be replaced, and the ink contained in the ink container PA can be moved into the ink container PB to collect the ink from the outside of the cartridge IC2. Of course, both of the ink containers PA and PB may be replaced from the outside of the cartridge IC2. According to this ink cartridge IC2, the sedimentary ink reception block for receiving a sedimentary ink is provided, whereby the sedimentary ink can be held to prevent the same from flowing out of the cartridge. Hence, it is possible to suppress supply of the sedimentary ink as part of the pigment-based ink (sedimentary ink supply-suppressing structure (1)). This makes it possible supply the pigment-based ink to the communication passage 27 and at the same time reduce unevenness of printing while.

Figure 3:
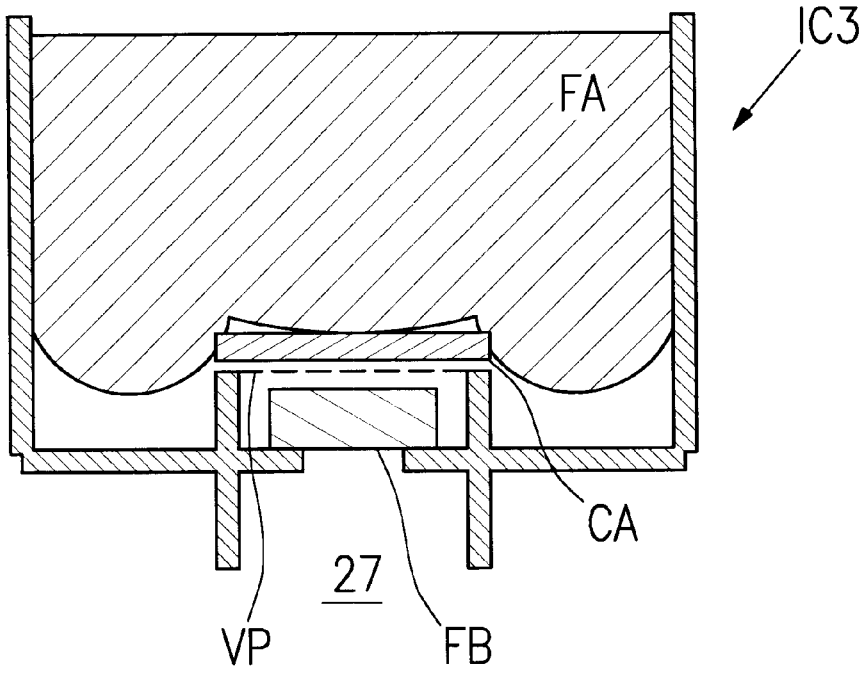
FIG. 3 is a cross-sectional view showing a schematic representation of an ink cartridge according to a third embodiment of the invention, which is useful in explaining an internal construction of the ink cartridge.

Next, in an ink cartridge IC3 according to a third embodiment of the invention shown in FIG. 3, a flow slowing lid CA for reducing the flow of the sedimentary ink into the communication passage 27 is arranged to cover the inner opening VP such that the flow slowing lid CA is in intimate contact with the surrounding wall of the inner portion of the ink delivery block 26. The pigment-based ink is delivered to the communication passage 27 through the flow slowing lid CA. A typical example of the flow slowing lid CA in this embodiment is a mesh (mesh filter). When passing through the mesh, the sedimentary ink is appropriately mixed with other part of the pigment-based ink (having a lower concentration), and the concentration of the sedimentary ink is reduced. This acts to make uniform the concentration of the mixture of the sedimentary ink and other part of the pigment-based ink (sedimentary ink supply-suppressing structure (1)), thereby enabling reduction of unevenness of printing.

Figure 4A:
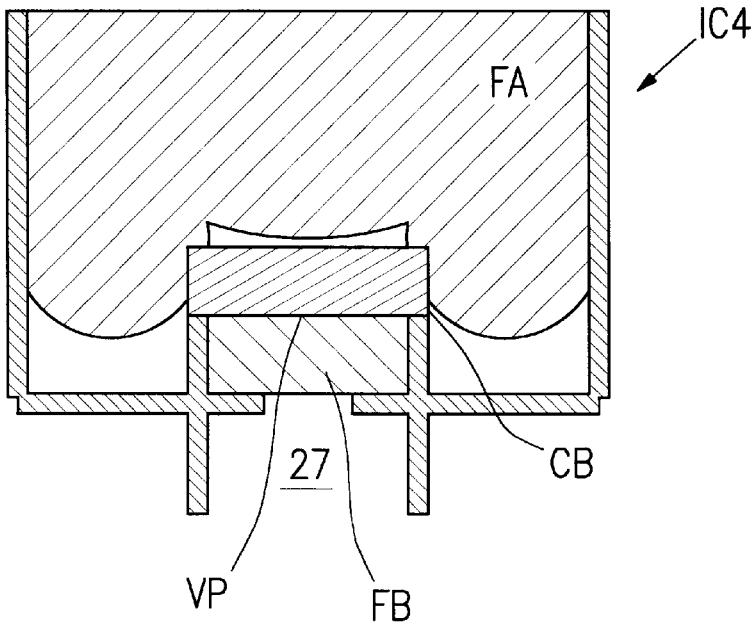
FIGS. 4A and 4B are cross-sectional views each showing a schematic representation of an ink cartridge according to a fourth embodiment of the invention, which is useful in explaining an internal construction of the ink cartridge.
Figure 4B:
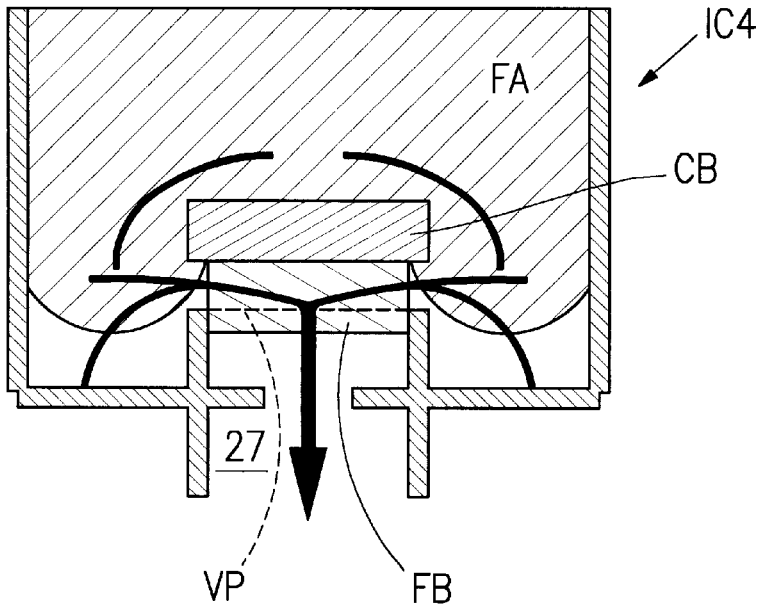

Next, in an ink cartridge IC4 according to a fourth embodiment of the invention shown in FIGS. 4A and 4B, the ink absorbent material FB (ink filter) has a top thereof joined to a communication lid CB, as shown in FIG. 4A, for intimate contact therewith such that the communication lid CB covers the inner opening VP to close the communication passage 27. The communication lid CB used in this embodiment is formed of a container or an ink absorbent material, and has a size larger than the size (the inner diameter) of the inner opening VP. Further, in order to prevent leakage of ink out of the ink cartridge IC4, the ink absorbent material FB as well is formed to have a slightly larger size than the size of the inner opening VP, and forcedly filled in the inner opening VP (by compressing the ink absorbent material FB). In this case, the communication lid CB is brought into intimate contact with the surrounding wall defining the inner opening VP e.g. by the urging force of the ink absorbent material FA, and while the ink cartridge IC4 is left unused, a state in which ink is prevented from flowing into the communication passage 27 is maintained, whereby no sedimentary ink is generated in the communication passage 27 (the ink-filled region DIb is not formed). That is, if the ink cartridge IC4 is left unused, the absence of the ink-filled region DIb contributes to suppressing the generation of a sedimentary ink (sedimentary ink generation-suppressing structure (2)), whereby it is possible to reduce unevenness of printing.

Further, as shown in FIG. 4B, when the communication lid CB is pressed upward via the ink absorbent material FB (ink filter) to form a gap between the communication lid CB and the surrounding wall defining the inner opening VP, the pigment-based ink is sucked or drawn in through the gap by a predetermined suction force whereby the ink is supplied to the communication passage 27. Therefore, even if there can be produced a sedimentary ink on the top of the communication lid CB when the ink cartridge IC4 is left unused, when the sedimentary ink passes through the gap formed by pressing the communication lid CB upward, together with other part of the pigment-based ink (having a lower concentration) than the sedimentary ink, the sedimentary ink is mixed with the other part of the pigment-based ink to decrease in its concentration, which acts to make uniform the concentration of the supplied ink. This makes it possible to suppress supply of the sedimentary ink (as it is) as part of the pigment-based ink (sedimentary ink supply-suppressing structure (1)), thereby reducing unevenness of printing.

Figure 5:
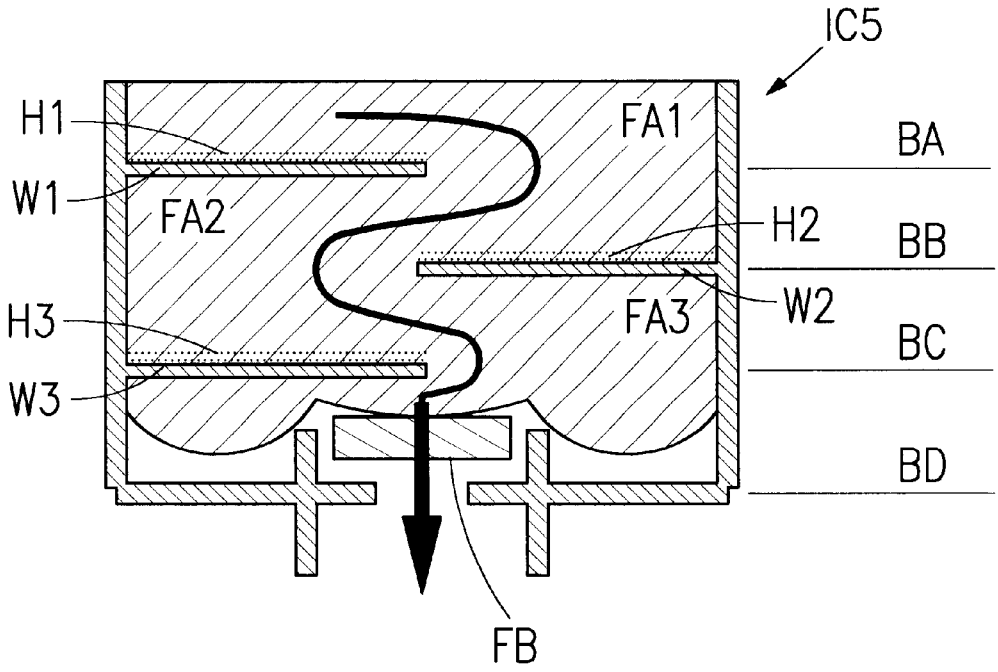
FIG 5 is a cross-sectional view showing a schematic representation of an ink cartridge according to a fifth embodiment of the invention, which is useful in explaining an internal construction of the ink cartridge.

Next, an ink cartridge IC5 according to a fifth embodiment of the invention shown in FIG. 5 has an ink reservoir provided with a plurality of (three, in this example) partitions W1, W2, W3 such that they divide the ink reservoir into a plurality of blocks. These partitions may be formed by plates fixed to the inner wall of the ink cartridge IC5, or formed as part of the inner wall of the same, so long as they are capable of stopping sedimentation of a coloring matter (pigment) of the pigment-based ink. The partitions W1, W2, W3 are arranged in a direction of stopping sedimentation of the coloring matter of the pigment-based ink (i.e. direction of blocking a flow path in a direction of sedimentation of the coloring matter). For instance, in the illustrated example, an opening not filled by the partition W1 and thereby communicating between adjacent blocks is positioned at a right half portion of the inner space, an opening not filled by the partition W2 and thereby communicating between adjacent blocks is positioned at a left half portion of the inner space, and an opening not filled by the partition W3 and thereby communicating between adjacent blocks is at the right half portion of the inner space. Therefore, the flow of (particles of) the coloring matter located above the partition W2, for instance, is stopped by the partition W2 to form a sedimentary ink H2 in the right half portion of the cartridge IC5, even if the cartridge is left unused. Further, in the left half portion of the cartridge IC5, as for part of the ink originally located above the partition W1, the flow of (particles of) the coloring matter is stopped by the partition W1 to form a sedimentary ink H1, whereas as for part of the ink originally located below the partition W1, the flow of (particles of) the coloring matter is stopped by the partition W3 to form a sedimentary ink H3.

More specifically, if a region above the partition W1 is referred to as a block BA, a region below the partition W1 and above the partition W2 (region between the partition W1 and the partition W2) is referred to as a block BB, a region between the partition W2 and the partition W3 is referred to as a block BC, and a region below the partition W3 is referred to as a block BD, in the ink cartridge IC5, the ink reservoir is divided into a plurality (four) blocks by the plurality of (three) partitions for partially blocking the flow of the coloring matter (pigment) in the direction of sedimentation thereof, and a plurality of openings which are not filled by the plurality of partitions and thereby communicating between adjacent ones of the blocks are formed such that the plurality of openings are not aligned in the direction of sedimentation of the coloring matter. Of course, a larger number of partitions may be provided to increase the number of blocks, and the plurality of openings may be arranged in a manner finely distributed in the ink reservoir. Further, as shown in the figure, if a plurality of ink absorbent materials FA1, FA2, FA3 and the like, not integrally formed as a unitary member, are employed in place of the ink absorbent material FA, the coloring matter is made difficult to migrate, whereby it is possible to further inhibit sedimentation of the coloring matter (pigment). Further, the ink holding force may be strengthened in the order of the ink absorbent materials FA1, FA2, and FA3, whereby it is possible to assist supply of ink by capillary action.

As described hereinabove, since the ink cartridge IC5 has a plurality of blocks divided by the partitions, ink flow passage between the blocks are formed by the plurality of openings which are not filled by the plurality of openings and thereby communicating between adjacent blocks. Here, the plurality of openings are not aligned in the direction of sedimentation of the coloring matter, and even if the ink cartridge IC5 is left unused to cause the coloring matter to settle out, particles of the coloring matter only sediment or fall on the next partition where further proceeding of the sedimentation is inhibited. This makes it possible to prevent the concentration of the coloring matter or sedimentary ink from becoming high. That is, the generation of a sedimentary ink having an extremely high concentration can be suppressed (sedimentary ink generation-suppressing structure (2)), thereby reducing unevenness of printing. Further, the ink flow path through the blocks is designed not to extend in parallel with the direction of sedimentation of the coloring matter, and ink flows in a dog-legged manner, so that portions of the ink having different concentrations are appropriately mixed with each other to make uniform the concentration of the mixture. This makes it possible to inhibit supply of the sedimentary ink as part of the pigment-based ink (sedimentary ink supply-suppressing structure (1)), thereby reducing unevenness of printing.

Figure 6:
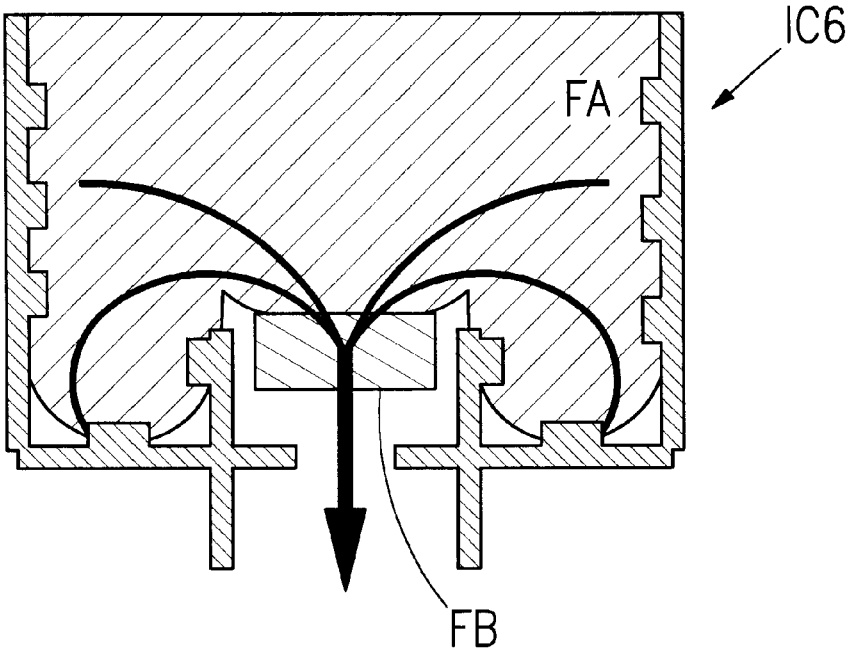
FIG. 6 is a cross-sectional view showing a schematic representation of an ink cartridge according to a sixth embodiment of the invention, which is useful in explaining an internal construction of the ink cartridge.

Next, an ink cartridge IC6 according to a sixth embodiment of the invention shown in FIG. 6 has an ink reservoir having an inner wall surface thereof formed with a plurality of protruding portions for compressing the ink absorbent material FA. Generally, a portion of the ink located along an inner wall surface of an ink cartridge migrates more easily to the ink-filled regions DIa and DIb than a portion of the ink held by an inner portion of the ink absorbent material FA, and further a portion of the ink positioned along an inner wall surface of the bottom (along a bottom surface) encounters a smaller resistance and flows more easily in comparison with a portion of the ink held by an inner portion of the ink absorbent material FA, so that a sedimentary ink generated along the inner wall is readily supplied to the communication passage 27. On the other hand, in the ink cartridge IC6, the ink absorbent material FA is compressed by the protruding portions formed on the inner wall surface, whereby the compressed portion of the ink absorbent material FA has an ink holding force (ink meniscus force) and is capable of suppressing the migration of ink and the diffusion of the coloring matter. This makes it possible to suppress sedimentation of the coloring matter and the generation of a sedimentary ink (sedimentary ink generation-suppressing structure (2)). Further, even if a sedimentary ink is produced along the inner wall surface, the protruding portions on the inner wall surface suppress the flow of the sedimentary ink, which makes it possible to suppress supply of the sedimentary ink as part of the pigment-based ink (sedimentary ink supply-suppressing structure (1)), thereby reducing unevenness of printing.

The above-mentioned ink cartridges IC1 to IC6, each of which includes an ink reservoir holding an ink absorbent material therein for storage of a pigment-based ink, and an ink delivery block formed with a communication passage for communicating between the inside and outside of the ink reservoir, have the same basic construction as that of the conventional ink cartridge, and when the ink cartridge is left unused, a sedimentary ink is produced. Therefore, if the ink is delivered as it is, the sedimentary portion (sedimentary ink) is mixed into the delivered ink (pigment-based ink), thereby causing unevenness of printing. That is, a so-called Delta E (ΔE) as an index of unevenness of printing (color difference between a desired color and a reproduced color) is increased.

To eliminate the above inconvenience, as described above, the respective ink cartridges IC1 to IC6 adopt the sedimentary ink supply-suppressing structures for suppressing supply of the sedimentary ink as part of the pigment-based ink, thereby reducing the Delta E (ΔE). It should be noted that the ideas of the first to third, fifth, and sixth embodiments can be applied to an ink cartridge of a type which does not use the ink absorbent material FB (ink filter), or a type which does not press the ink absorbent material FB upward during supply of ink even if the ink absorbent material FB is employed.

Figure 7:
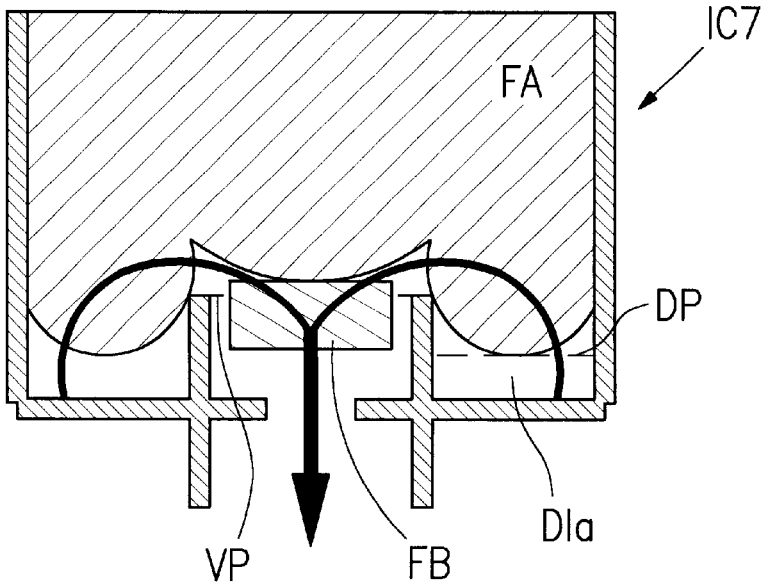
FIG. 7 is a cross-sectional view showing a schematic representation of an ink cartridge according to a seventh embodiment o the invention, which is useful in explaining an internal construction of the ink cartridge.

Next, in an ink cartridge IC7 according to a seventh embodiment of the invention shown in FIG. 7, the ink absorbent material FA is filled to a location DP below the inner opening VP, whereby a portion filled with ink alone (ink-filled region DIa)can be reduced. This reduction of the ink-filled region DIa contributes to suppressing the generation of a sedimentary ink, if the ink cartridge IC7 is left unused (sedimentary ink generation-suppressing structure (2)), which makes it possible to reduce unevenness of printing while supplying the pigment-based ink.

Figure 8:
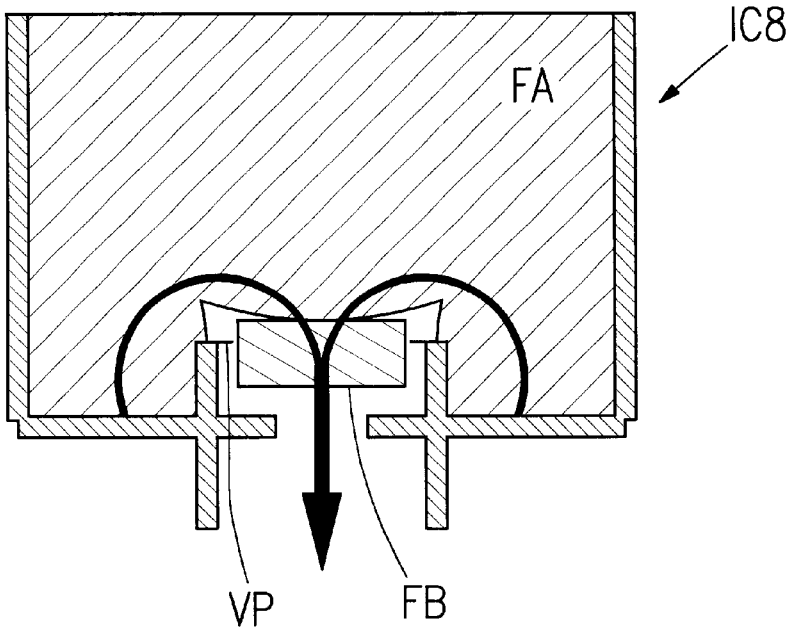
FIG. 8 is a cross-sectional view showing a schematic representation of an ink cartridge according to an eighth embodiment of the invention, which is useful in explaining an internal construction of the ink cartridge.

Next, in an ink cartridge IC8 according to an eighth embodiment of the invention shown in FIG. 8, by carrying the idea of the ink cartridge IC7 a step further, an ink absorbent material (ink absorbent material FA in the illustrated example) having the same properties as those of the ink absorbent material FA is filled to the bottom located below the level of the inner opening VP, whereby a portion filled with ink alone (ink-filled region DIa) can be eliminated. This elimination of the ink-filled region DIa contributes to suppressing the generation of a sedimentary ink, even if the ink cartridge IC8 is left unused (sedimentary ink generation-suppressing structure (2)), which makes it possible to reduce unevenness of printing while supplying the pigment-based ink.

Figure 9:
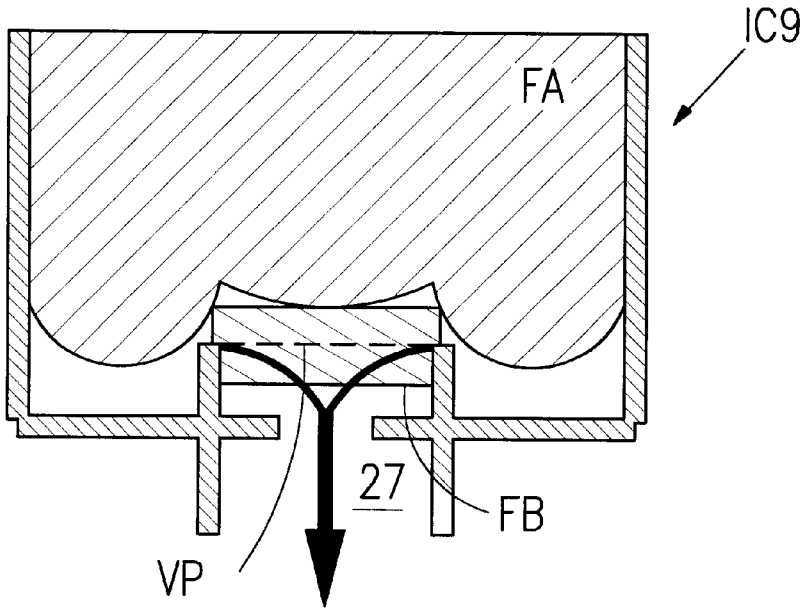
FIG. 9 is a cross-sectional view showing a schematic representation of an ink cartridge according to a ninth embodiment of the invention, which is useful in explaining an internal construction of the ink cartridge.

Next, in an ink cartridge IC9 according to a ninth embodiment of the invention shown in FIG. 9, the ink absorbent material FB (ink filter) is formed to have a larger size than the size of the inner opening VP, and forcedly filled in the communication passage 27 e.g. by compressing the same to be retained therein. Accordingly, while the ink cartridge IC9 is left unused, the ink absorbent material FB serves as the lid of the communication passage 27 to stop (or reduce) supply of ink to the communication passage 27. Hence, there is not generated any sedimentary ink within the communication passage 27. That is, even if the ink cartridge IC9 is left unused, the absence of the ink-filled region DIb contributes to suppressing the generation of a sedimentary ink (sedimentary ink generation-suppressing structure (2)), thereby making it possible to reduce unevenness of printing while supplying the pigment-based ink.

Figure 10A:
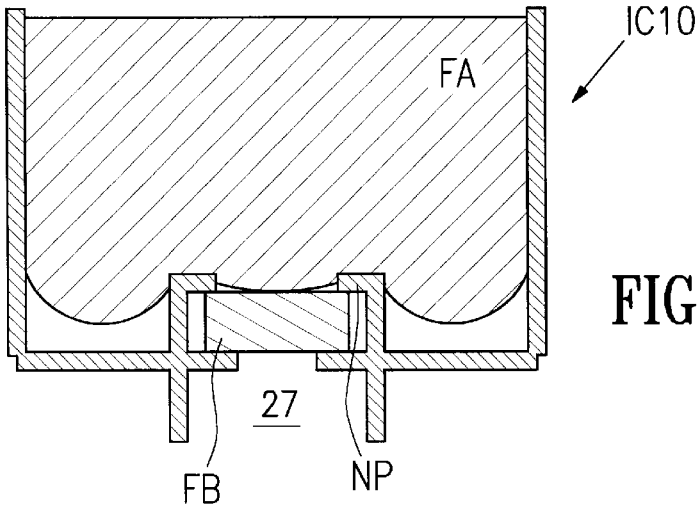
FIGS. 10A to 10C are cross-sectional views each showing a schematic representation of an ink cartridge according to a tenth embodiment of the invention, which is useful in explaining an in internal construction of the ink cartridge.
Figure 10B:
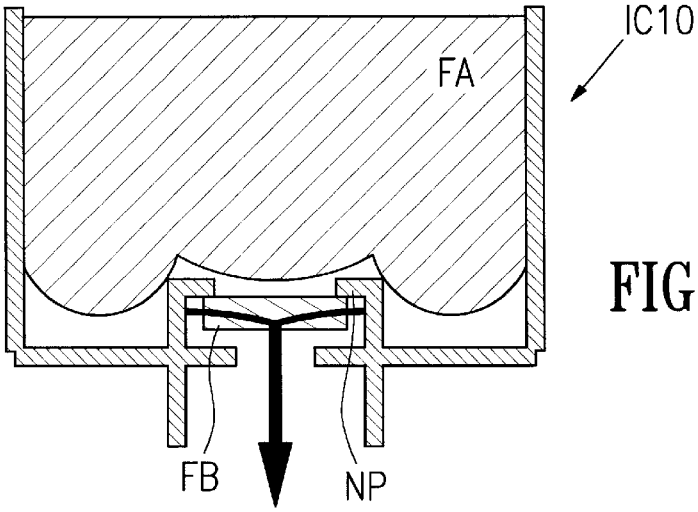
Figure 10C:
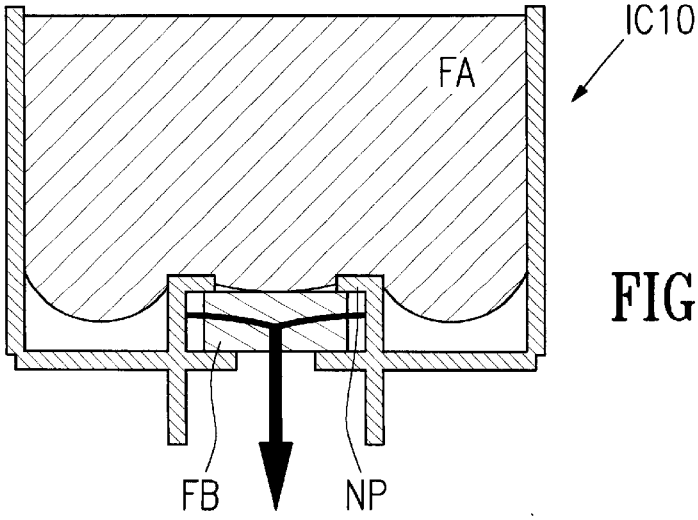

Next, in an ink cartridge IC10 according to a tenth embodiment of the invention shown in FIGS. 10A to 10C, a nail portion NP is provided, as shown in FIG. 10A, which covers a gap between the inner peripheral surface of the surrounding wall defining the communication passage 27 and the ink absorbent material FB, and at the same time urges the ink absorbent material FB downward. Therefore, when the ink cartridge IC10 is left unused, the nail portion NP covers the gap between the inner peripheral surface of the surrounding wall defining the communication passage 27 and the ink absorbent material FB, and serves as the lid of the communication passage 27 together with the ink absorbent material FB, thereby reducing supply of ink to the communication passage 27. Hence, the generation of a sedimentary ink is suppressed within the communication passage 27. That is, even if the ink cartridge IC10 is left unused, it is possible to suppress the generation of a sedimentary ink (sedimentary ink generation-suppressing structure (2)), thereby making it possible to reduce unevenness of printing during supply of the pigment-based ink. Further, as described above with reference to FIG. 17B, when the ink absorbent material FB is urged upward by the receiving member 6 or the like during supply of ink, as shown in FIG. 10B, the urging force is absorbed by the resilience of the ink absorbent material FB, whereas when the ink absorbent material FB is not urged upward during supply of ink, as shown in FIG. 10C, the ink is delivered through the absorbent material FB not urged.

Figure 11A:
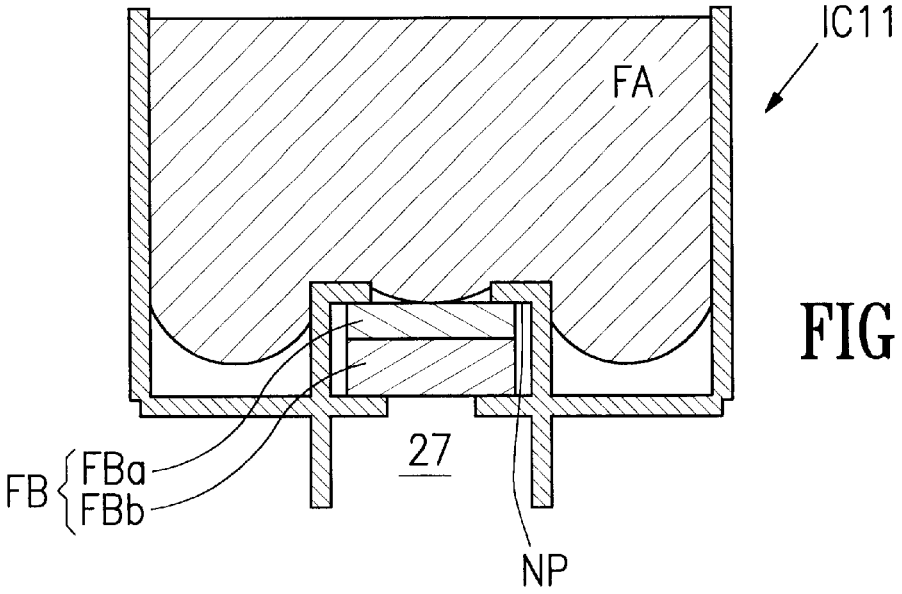
FIGS. 11A and 11B are cross-sectional views each showing a schematic representation of an ink cartridge according to an eleventh embodiment of the invention, which is useful in explaining an internal construction of the ink cartridge.
Figure 11B:
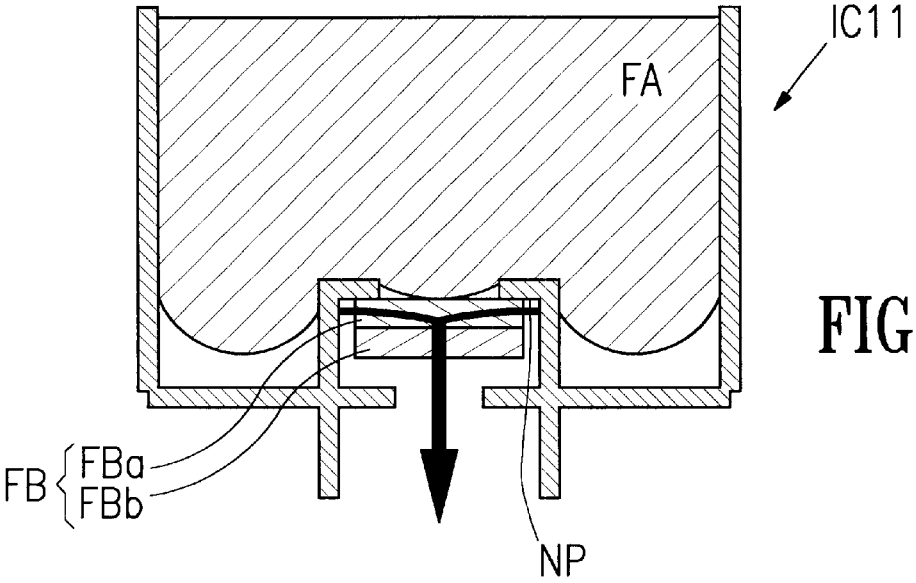

Next, in an ink cartridge IC11 according to an eleventh embodiment of the invention shown in FIGS. 11A to 11B, the ink absorbent material FB (ink filter) is formed of a laminate of a plurality of (two in this example) types of ink absorbent materials FBa and FBb, as shown in FIG. 11A, which are different in resilience from each other. This makes it possible to finely adjust the resilience of the ink absorbent material FB as a whole. For instance, as shown in FIG. 11B, assuming that the ink absorbent material FB is urged upward by the receiving member 6 during delivery of ink, if the use of the ink absorbent material FBa to form the whole ink absorbent material FB causes lack of resilience, a laminate of the same and the ink absorbent material FBb having a high resilience enables adjustment of a contact pressure between the ink absorbent material FB and the receiving member 6. This holds true with a case of reverse adjustment of resilience. Further, if the ink absorbent materials FBa and FBb have the effect of collecting foreign matter to be flown out (dust collection effect: i.e. filter effect), the effect is enhanced by employing a plurality of ink absorbent materials.

Figure 12A:
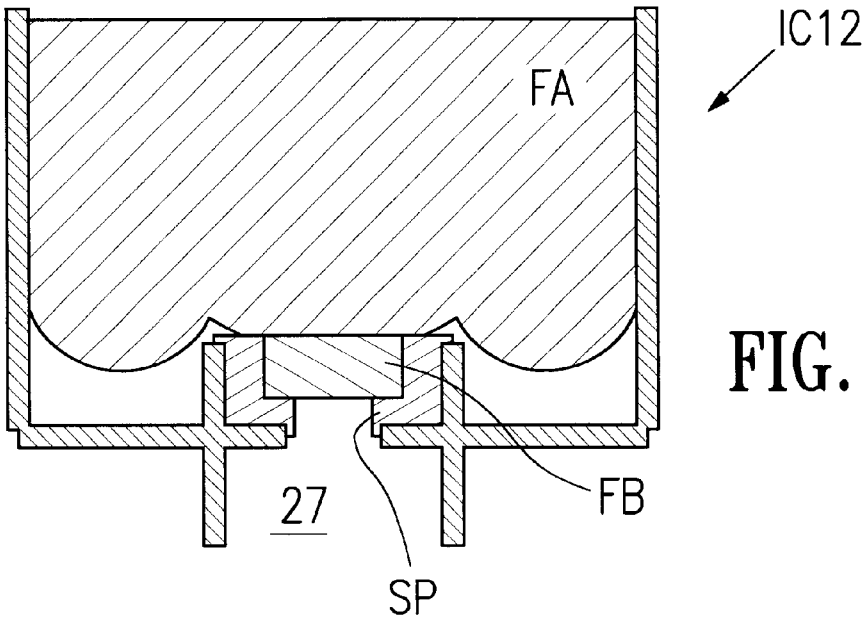
FIGS. 12A and 12B are cross-sectional views each showing a schematic representation of an ink cartridge according to a twelfth embodiment of the invention, which is useful in explaining an internal construction of the ink cartridge.
Figure 12B:
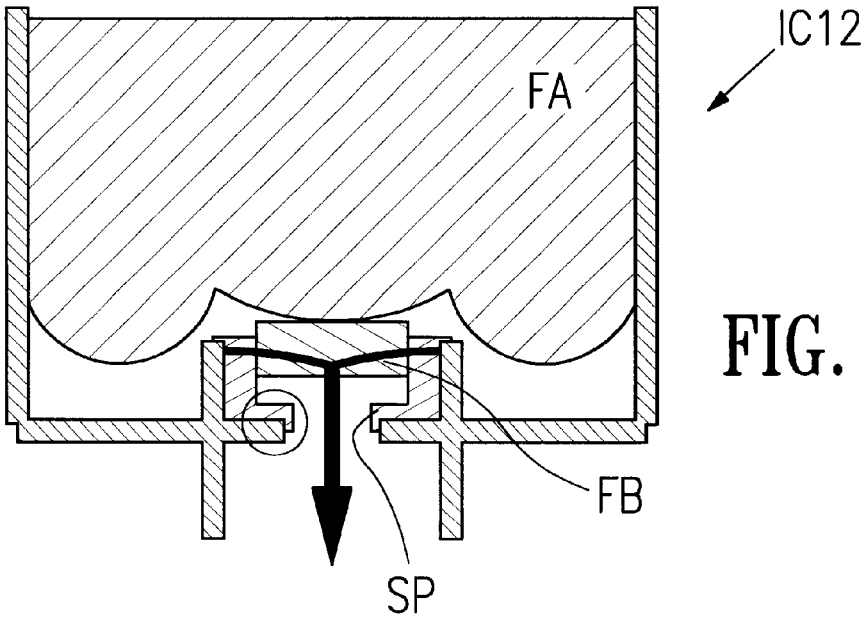

Next, in an ink cartridge IC12 according to a twelfth embodiment of the invention shown in FIGS. 12A and 12B, the pigment-based ink is supplied to the communication passage 27 by suction via the ink absorbent material FB (ink filter) by a predetermined suction force. In addition to the ink absorbent material FB, the ink cartridge IC12 holds a spacer (filling material) SP for filling a gap (ink-filled region DIb) between the ink absorbent material FB and the inner peripheral surface of the surrounding wall of the communication passage 27. Therefore, even if the ink cartridge IC12 is left unused, the absence of the ink-filled region DIb contributes to suppressing the generation of a sedimentary ink (sedimentary ink generation-suppressing structure (2)), thereby making it possible to reduce unevenness of printing while supplying the pigment-based ink. Further, in the case of a spacer having a gasket or packing effect, it is possible to prevent or suppress evaporation of ink as well as leakage of ink which is liable to occur when an ink cartridge is set in the cartridge holder 2, by the gasket or packing effect of a portion indicated by a mark "○" appearing in FIG. 12B.

Figure 13:
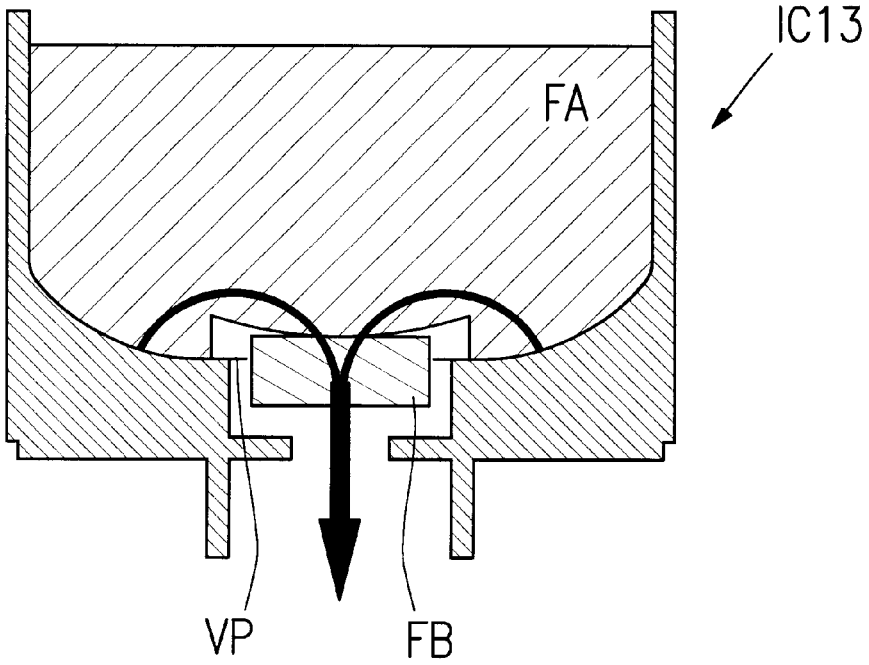
FIG. 13 is a cross-sectional view showing a schematic representation of an ink cartridge according to a thirteenth embodiment of the invention, which is useful in explaining an internal construction of the ink cartridge.

Next, in an ink cartridge IC13 according to a thirteenth embodiment of the invention shown in FIG. 13, the inner opening VP is arranged in the lowermost surface of the ink reservoir such that the bottom surface of the ink reservoir is located above the inner opening VP, and at the same time slopes downward toward the inner opening VP. Hence, even if the ink cartridge IC13 is left unused, it becomes difficult for a sedimentary ink to deposit, and when depositing, it falls downward toward the inner opening VP for sedimentation, so that the sedimentary ink can be eliminated upon the initial supply of ink after the ink cartridge has been left unused (sedimentary ink elimination-accelerating structure (3)), thereby making it possible to reduce unevenness of printing while supplying the pigment-based ink. Further, this enables a portion corresponding to the ink-filled region DIa to be eliminated to provide the ink absorbent material FA on the whole bottom surface, whereby it is possible to suppress the diffusion of pigments in the ink as well as the generation of a sedimentary ink (sedimentary ink generation-suppressing structure (2)), which makes it possible to reduce unevenness of printing while supplying the pigment-based ink. It should be noted that the sloping surface in this embodiment may be formed into a curved shape (curved surface) shown in the figure, or may be also formed into a linear shape (flat surface).

As described hereinabove, the ink cartridges IC4 to IC13 adopt the sedimentary ink generation-suppressing structures for suppressing the generation of a sedimentary ink, respectively, thereby reducing the Delta E. It should be noted that the ideas of the seventh, eighth, and thirteenth embodiments can be applied to an ink cartridge of a type which does not use the ink absorbent material FB (ink filter), or a type which does not urge the ink absorbent material FB upward during supply of the pigment-based ink even if the ink absorbent material FB is employed. Further, the ideas of the ninth, eleventh, and twelfth embodiments can be applied to an ink cartridge of the type which does not urge the ink absorbent material FB upward during delivery of the pigment-based ink.

Figure 14:
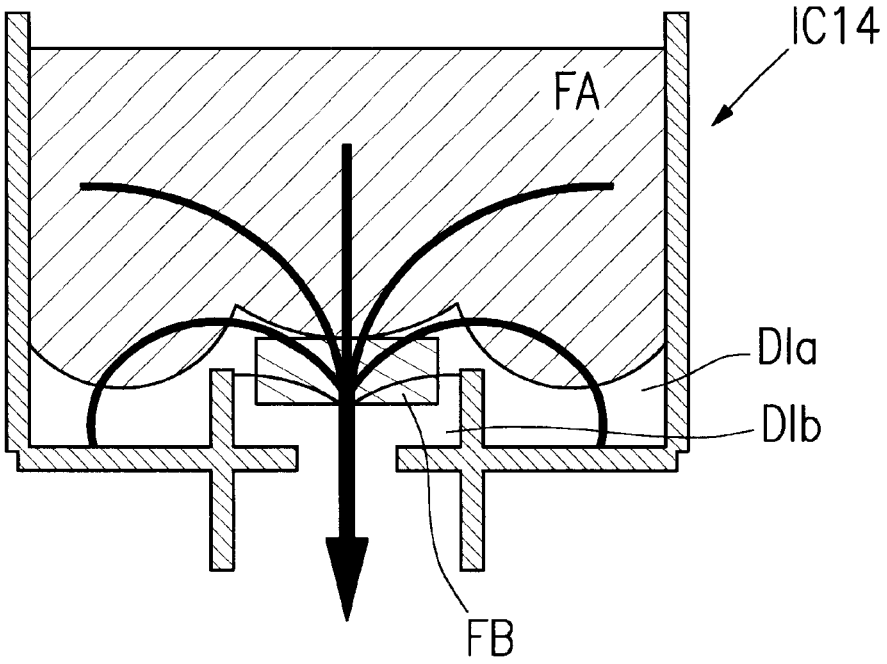
FIG. 14 is a cross-sectional view showing a schematic representation of an ink cartridge according to a fourteenth embodiment of the invention, which is useful in explaining an internal construction of the ink cartridge.

Next, in an ink cartridge IC14 according to a fourteenth embodiment of the invention shown in FIG. 14, the relationship between the ink holding force of the ink absorbent material FA and that of the ink absorbent material FB is inverted with respect to the ink cartridge IC for holding a dye-based ink, described above with reference to FIGS. 17A and 17B, wherein the ink absorbent material FA has a larger ink holding force than that of the ink absorbent material FB. That is, in contrast to the conventional relationship of "the ink holding force of the ink absorbent material FA<that of the ink absorbent material FB", the ink cartridge IC14 has the relationship of "the ink holding force of the ink absorbent material FA≧that of the ink absorbent material FB".

The reason for the conventional relationship of "the ink holding force of the ink absorbent material FA<that of the ink absorbent material FB" is that it is intended to accelerate the flow of ink in the direction of the ink absorbent material FA→the ink absorbent material FB, thereby assisting supply of ink. Of course, the suction force required for supply of ink is also designed such that the same is applied mainly in the direction of the ink absorbent material FA→the ink absorbent material FB. Further, the ink-filled region DIa and DIb are arranged on the bottom of the ink reservoir. Accordingly, from the viewpoint of the direction of the suction force, ink held by the ink absorbent material FA is easier to be sucked than ink in the ink-filled region DIa and DIb. On the other hand, since the ink-filled region DIa and DIb do not have any ink holding force, it is more difficult for them to hold ink than for the ink absorbent material FA (which has an ink holding force although the force is smaller than that of the ink absorbent material FB). In short,from the viewpoint of the ink holding force, a portion of the ink in the ink-filled region DIa and DIb is easier to be sucked or drawn in.

In the case of the dye-based ink, it does not present any problem even if the suction force and the ink holding force are in a delicate, i.e. easily variable relationship. In the case of the pigment-based ink, however, a sedimentary ink is accumulated in the ink-filled region DIa and DIb, especially immediately after the ink cartridge starts to be used after it was left unused. If the suction force and the ink holding force are in a delicate, i.e. easily variable relationship, the sedimentary ink is irregularly mixed into the pigment-based ink being sucked (supplied), causing unevenness of printing. To overcome the above problem, in the ink cartridge IC14, the ink holding forces of the ink absorbent materials are set to satisfy a condition of "the ink holding force of the ink absorbent material FA≧that of the ink absorbent material FB", whereby the ink in the ink-filled region DIa and DIb is made still easier to be sucked. This enables the sedimentary ink to be eliminated upon the initial supply of ink after the ink cartridge has been left unused (sedimentary ink elimination-accelerating structure (3)), which makes it possible to reduce unevenness of printing while supplying the pigment-based ink. It should be noted that the idea of the present embodiment can also be applied to an ink cartridge of the type which does not urge the ink absorbent material FB upward during supply of the pigment-based ink. Further, by reinforcing the ink holding force of the ink absorbent material FA, it is possible to suppress the flow (sedimentation) of the coloring matter (pigment) from the ink absorbent material FA to the ink-filled region DIa and DIb (sedimentary ink generation-suppressing structure (2)).

As described hereinbefore, the respective ink cartridges IC13 and IC14 adopt the sedimentary ink elimination-accelerating structures which are capable of removing a sedimentary ink upon the initial supply of ink after the ink cartridge has been left unused. This enables reduction of unevenness of printing which is carried out after eliminating the sedimentary ink. Particularly, in the ink jet printer or the like, after the ink cartridge thereof has been left unused, an ink ejection operation (so-called cleaning operation) is carried out to clear nozzles in the print head, and hence if the sedimentary ink can be cleared in the course of the processing, it contributes to reduction of unevenness of printing which can occur after the start of normal printing.

Further, in the case of inks for use in color printing, if four primary colors consisting of C (cyan), M (magenta), Y (yellow), and K (black) are distinguished from each other in molecular weight (or readiness for sedimentation), for instance, if any one (e.g. the color C) of the four colors has pigments largest in molecular weight (i.e. is readier to settle out than any of the three other colors), the ink cartridge may be configured on a color-by-color basis.

It is further understood by those skilled in the art that the foregoing are preferred embodiments of the invention, and that various changes and modifications may be made without departing from the spirit and scope thereof.

What is claimed is:

1. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink supply-suppressing member for suppressing flow of a sedimentary ink to said inner opening, said sedimentary ink having an increased coloring matter concentration caused by sedimentation of a coloring matter floating in said pigment-based ink;

wherein said inner opening is arranged above a lowermost bottom surface inside said ink reservoir, and wherein said sedimentary ink supply-suppressing member comprises an ink receiving container arranged in a bottom portion of said ink reservoir below said inner opening, for receiving said sedimentary ink.

2. An ink cartridge according to claim 1, wherein said ink receiving container comprises a first ink container arranged inside said ink reservoir and a second ink container arranged outside said ink reservoir.

3. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink supply-suppressing member for suppressing flow of a sedimentary ink to said inner opening, said sedimentary ink having an increased coloring matter concentration caused by sedimentation of a coloring matter floating in said pigment-based ink;

wherein said sedimentary ink supply-suppressing member comprises an ink filter formed of a predetermined ink absorbent material and held within said communication passage at a location near said inner opening, and a lid joined to a top of said filter for close contact therewith such that said lid covers said inner opening to block said communication passage, and wherein said pigment-based ink is supplied by being drawn in by a predetermined suction force via said ink filter through a gap formed between said lid and said ink delivery block when said lid is pressed upward via said ink filter.

4. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink supply-suppressing member for suppressing flow of a sedimentary ink to said inner opening, said sedimentary ink having an increased coloring matter concentration caused by sedimentation of a coloring matter floating in said pigment-based ink;

wherein said sedimentary ink supply-suppressing member comprises a plurality of partitions arranged such that said plurality of partitions partially block flow of said coloring matter in a direction of sedimentation thereof, and wherein said ink reservoir is divided by said partitions into a plurality of blocks, such that openings not filled by said plurality of partitions and thereby connecting between adjacent ones of said plurality of blocks are not aligned in said direction of sedimentation of said coloring matter.

5. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink supply-suppressing member for suppressing flow of a sedimentary ink to said inner opening, said sedimentary ink having an increased coloring matter concentration caused by sedimentation of a coloring matter floating in said pigment-based ink;

wherein said sedimentary ink supply-suppressing member comprises a plurality of protrusions provided on an inner wall of said ink reservoir, for compressing said ink absorbent material.

6. An ink cartridge comprising:

an ink reservoir holding an ink absorbent material therein for storage of a pigment-based ink;

an ink delivery block formed at a lower portion of said ink reservoirs and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said sedimentary ink generation-suppressing member comprises an ink filter formed of a predetermined ink absorbent material and being held within said communication passage at a location near said inner opening, and a nail portion provided on said ink delivery block such that said nail portion covers a gap between an inner peripheral surface of said ink delivery block defining said communication passage and said ink filter while urging said ink filter downward, and wherein said pigment-based ink is supplied bar being drawn in via said ink filter by a predetermined suction force.

7. An ink cartridge according to claim 6, wherein said pigment-based ink is supplied in a state in which said ink filter is pressed upward from below, and wherein said ink filter is formed of a laminate of a plurality of types of ink absorbent materials different in resilience from each other.

8. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said sedimentary ink generation-suppressing member comprises an ink filter formed of a predetermined ink absorbent material and arranged within said communication passage at a location near said inner opening, and a filling member for filling a gap between an inner peripheral surface of said ink delivery block defining said communication passage and said ink filter, and wherein said pigment-based ink is supplied by being drawn in via said ink filter by a predetermined suction force.

9. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said sedimentary ink generation-suppressing member comprises an ink filter formed of a predetermined ink absorbent material and held within said communication passage at a location near said inner opening, and a lid joined to a top of said filter for close contact therewith such that said lid covers said inner opening to block said communication passage, and wherein said pigment-based ink is supplied by being drawn in via said ink filter by a predetermined suction force through a gap formed between said lid and said ink delivery block when said lid is pressed upward via said ink filter.

10. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said sedimentary ink generation-suppressing member comprises a plurality of partitions arranged such that said plurality of partitions partially block flow of said coloring matter in a direction of sedimentation thereof, and wherein said ink reservoir is divided by said partitions into a plurality of blocks, such that openings not filled by said plurality of partitions and thereby connecting between adjacent ones of said plurality of blocks are not aligned in said direction of sedimentation of said coloring matter.

11. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of sad ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said sedimentary ink generation-suppressing member comprises a plurality of protrusions provided on an inner wall of said ink reservoir, for compressing said ink absorbent material.

12. An ink cartridge comprising:

an ink reservoir holding an ink absorbent material therein for storage of a pigment-based ink;

an ink delivery block formed at a lower portion of said ink reservoir, and having a communication passage formed therethrough such that said communication passage extends from an outside of said ink reservoir up to an inter opening of said communication passage which opens into an inside of said ink reservoir, for communication between said outside and said inside of said ink reservoir; and a sedimentary ink generation-suppressing member for suppressing generation of a sedimentary ink having an increased pigment concentration caused by sedimentation of a coloring matter floating in said pigment-based ink, said sedimentary ink generation-suppressing member slowing down flow of a coloring matter within a predetermined sedimentation region where sedimentation of said coloring matter easily proceeds, or flow of the pigment-based ink into said predetermined sedimentation region;

wherein said inner opening opens in a lowermost portion within said ink reservoir such that a bottom surface of said ink reservoir is located above said inner opening, and slopes downward toward said inner opening, and wherein said sedimentary ink generation-suppressing member comprises said ink absorbent material arranged on a whole of said bottom surface.

13. An ink cartridge comprising:

an ink reservoir holding an ink absorbent material therein for storage of a pigment-based ink; and an ink delivery block formed at a lower portion of said ink reservoir, and having a communication passage formed therethrough such that said communication passage extends from an outside of said ink reservoir up to an inner opening of said communication passage which opens into an inside of said ink reservoir, for communication between said outside and said inside of said ink reservoir;

wherein said ink cartridge is constructed to accelerate flow of said pigment-based ink from a predetermined sedimentation region wherein sedimentation of a coloring matter easily proceeds toward said inner opening, so as to enable removal of a sedimentary ink having an increased coloring matter concentration caused by said sedimentation of said coloring matter floating in said pigment-based ink, by initial supply of said ink after said ink cartridge is left unused;

wherein said inner opening opens in a lowermost portion within said ink reservoir such that a bottom surface of said ink reservoir is located above said inner opening, and slopes downward toward said inner opening.

* * * * *